US009097391B2

(12) United States Patent
Mikami et al.

(10) Patent No.: US 9,097,391 B2
(45) Date of Patent: Aug. 4, 2015

(54) LAMP

(71) Applicants: IWASAKI ELECTRIC CO., LTD., Tokyo (JP); EYE LIGHTING SYSTEMS CORPORATION, Tokyo (JP)

(72) Inventors: Takahiro Mikami, Gyoda (JP); Yuuichi Kimoto, Konosu (JP); Nobuyuki Baba, Konosu (JP); Takayoshi Imanari, Gyoda (JP)

(73) Assignees: IWASAKI ELECTRIC CO., LTD., Tokyo (JP); EYE LIGHTING SYSTEMS CORPORATION, Tokyo (JP)

( * ) Notice: Subject to any disclaimer, the term of this patent is extended or adjusted under 35 U.S.C. 154(b) by 0 days.

(21) Appl. No.: 14/352,382

(22) PCT Filed: Oct. 23, 2012

(86) PCT No.: PCT/JP2012/077307
§ 371 (c)(1),
(2) Date: Apr. 17, 2014

(87) PCT Pub. No.: WO2013/069446
PCT Pub. Date: May 16, 2013

(65) Prior Publication Data

US 2014/0328064 A1 Nov. 6, 2014

(30) Foreign Application Priority Data

Nov. 9, 2011 (JP) ..... 2011-245238
Nov. 9, 2011 (JP) ..... 2011-245239
Nov. 9, 2011 (JP) ..... 2011-245240
Jan. 31, 2012 (JP) ..... 2012-017830

(51) Int. Cl.
*F21V 29/00* (2006.01)
*F21K 99/00* (2010.01)
(Continued)

(52) U.S. Cl.
CPC ..... *F21K 9/13* (2013.01); *F21V 29/004* (2013.01); *F21V 29/74* (2015.01); *F21V 29/83* (2015.01);
(Continued)

(58) Field of Classification Search
CPC ..... F21K 9/13; F21V 29/004; F21V 29/74; F21V 29/83; F21V 31/00; F21Y 2101/02; F21Y 2103/003; F21Y 2111/005
USPC ..... 362/218, 249.02–249.06, 294, 373
See application file for complete search history.

(56) References Cited

U.S. PATENT DOCUMENTS 8,680,754 B2 * 3/2014 Premysler ..... 362/294
2010/0265710 A1 10/2010 Xiao et al.
(Continued)

FOREIGN PATENT DOCUMENTS

JP 04-303509 A 10/1992
JP 2004-296245 A 10/2004
(Continued)

OTHER PUBLICATIONS

International Search Report mailed Jan. 15, 2013 for the corresponding PCT Application No. PCT/JP2012/077307.
(Continued)

*Primary Examiner* — Stephen F Husar
(74) *Attorney, Agent, or Firm* — Leason Ellis LLP

(57) ABSTRACT

A lamp achieves high output power like an HID lamp by using a light emitting element(s) as a light source. A mount board having LED mounted thereon is provided on the surface of a base member, and there are provided plural flat plate type light source units arranged around an axial line while the back surfaces thereof faces inwards, and a support member provided on the axial line. The plural light source units are supported on the support member, and a space through which air flows is provided at the back surface side of each base member.

17 Claims, 16 Drawing Sheets

(51) Int. Cl.

| | |
|---|---|
| ***F21V 31/00*** | (2006.01) |
| ***F21V 29/74*** | (2015.01) |
| ***F21V 29/83*** | (2015.01) |
| *F21Y 101/02* | (2006.01) |
| *F21Y 103/00* | (2006.01) |
| *F21Y 111/00* | (2006.01) |

(52) U.S. Cl.
CPC ..... *F21V 31/00* (2013.01); *F21Y 2101/02* (2013.01); *F21Y 2103/003* (2013.01); *F21Y 2111/005* (2013.01)

(56) References Cited

U.S. PATENT DOCUMENTS

| | | | | |
|---|---|---|---|---|
| 2011/0089830 | A1 | 4/2011 | Pickard et al. | |
| 2011/0089838 | A1* | 4/2011 | Pickard et al. | 362/249.01 |
| 2011/0156584 | A1* | 6/2011 | Kim | 362/294 |

FOREIGN PATENT DOCUMENTS

| | | | |
|---|---|---|---|
| JP | 2006-244725 | A | 9/2006 |
| JP | 2008-204671 | A | 9/2008 |
| JP | 2010-010134 | A | 1/2010 |
| JP | 3163243 | U | 10/2010 |
| JP | 2010-251325 | A | 11/2010 |
| JP | 3164034 | U | 11/2010 |
| JP | 2010-286600 | A | 12/2010 |
| WO | WO-2009/091562 | A | 7/2009 |
| WO | WO-2010/024583 | A | 3/2010 |
| WO | WO-2011/004680 | A | 1/2011 |
| WO | WO-2011/118992 | A | 9/2011 |

OTHER PUBLICATIONS

International Preliminary Examination Report mailed May 22, 2014 for the corresponding PCT Application No. PCT/JP2012/077307.

Notice of third party submission provision of information by presentation of publication mailed Jan. 27, 2015 for the corresponding Japanese Application No. 2011-245238.

Notice of third party submission provision of information by presentation of publication mailed Jan. 27, 2015 for the corresponding Japanese Application No. 2011-245240.

* cited by examiner

LAMP

CROSS-REFERENCE TO RELATED PATENT APPLICATIONS

This application is a U.S. National Phase Application under 35 U.S.C. §371 of International Patent Application No. PCT/JP2012/077307, filed Oct. 23, 2012, and claims the benefit of Japanese Patent Applications No. 2011-245238, filed Nov. 9, 2011, No. 2011-245239, filed Nov. 9, 2011, No. 2011-245240, filed Nov. 9, 2011 and No. 2012-017830, filed Jan. 31, 2012, all of which are incorporated by reference in their entirety herein. The International Application was published in Japanese on May 16, 2013 as International Publication No. WO/2013/069446 under PCT Article 21(2).

FIELD OF THE INVENTION

The present invention relates to a lamp using a light emitting device such as LED (Light Emitting Diode), organic EL (Electra Luminescence) or the like as a light source.

BACKGROUND OF THE INVENTION

In connection with increase of output power and decrease in cost of LED as one type of a semiconductor light emitting device, a base type LED usable as an alternative to an electric bulb has been proposed and put to practical use (see JP-A-2010-010134, for example).

Problem to be Solved by the Invention

However, there has not been currently any LED lamp which is suitably usable as an alternative to a high output lamp such as HID (High Intensity Discharge) lamp.

SUMMARY OF THE INVENTION

The present invention has an object to provide a lamp that can solve the problem of the prior art described above and enables high output power like an HID lamp by using a light emitting device as a light source.

Means of Solving the Problem

In order to attain the above object, according to the present invention, there is provided a lamp including: a plurality of flat plate type light source units arranged around an axial line while back surfaces thereof face inwards, each of the light source units having a mount board having a light emitting element (s) mounted on the surface of abase member; and a support member provided on the axial line, wherein the plurality of light source units are supported on the support member while a gap is provided between the adjacent light source units, and a space through which air flows is provided at the back surface side of each base member.

According to the present invention, in the above lamp, the support member has a storage body in which respective lead wires from the plurality of light source units are accommodated without being exposed to the space through which air flows, and the plurality of light source units are supported on the storage body.

According to the present invention, in the above lamp, one ends of the plurality of light source units are cantilevered to the periphery of the storage body.

According to the present invention, in the above lamp, the other ends of the plurality of light source units are joined to one another by a joint member, and the joint member is provided with an opening through which the space intercommunicates with the outside in the direction of the axial line.

According to the present invention, in the above lamp, the storage body is provided with a base.

According to the present invention, in the above lamp, connectors are secured to the wires from the plurality of light source units, and a board in which the connectors are inserted is provided in the storage body.

According to the present invention, in the above lamp, the surface of the base member has a waterproof structure for waterproofing the mount board, a lead-out hole for leading out the lead wires is provided to the back surface of the base member, the support member has a lead-in hole for leading the lead wires from the lead-out hole into the support member, the light source unit and the support member are brought into close contact with each other to waterproof the lead-out hole and the lead-in hole, and the respective lead wires accommodated in the storage body are waterproofed by blocking the storage body.

According to the present invention, in the above lamp, the storage body is provided with a base, and the storage body is blocked by the base.

According to the present invention, in the above lamp, the storage body is provided with the lead-in hole.

According to the present invention, in the above lamp, the light source unit has a waterproof cover which covers the mount board.

According to the present invention, in the above lamp, the back surface of the base member is provided with a plurality of heat radiation fins.

According to the present invention, in the above lamp, the support member has a column extending from the storage body, one ends of the plurality of light source units are supported on the storage body, and the other ends thereof are supported on the tip of the column.

According to the present invention, in the above lamp, the support member is provided with a plurality of heat radiation fins.

According to the present invention, in the above lamp, the support member is provided with projecting portions, and the light source units are supported on the projecting portions.

According to the present invention, in the above lamp, the projecting portions extend in a longitudinal direction of the support member, and the back surfaces of the base members are in contact with the projecting portions.

According to the present invention, in the above lamp, the projecting portions is configured so that the center portion thereof is higher than both the end portions thereof in the longitudinal direction of the support member.

According to the present invention, in the above lamp, the projecting portions are radially provided to the support member, a plurality of support members which are different in number of the projecting portions are prepared, the plurality of light source units have the same shape, and the output power of the lamp is changeable by changing the number of light source units to be secured to the support member.

Effect of the Present Invention

According to the present invention, the lamp has the plural flat plate type light source units arranged around the axial line while the back surfaces thereof face inwards, each of the light source units having the mount board having the light emitting element(s) mounted on the surface of the base member, and the support member provided on the axial line, wherein the plural light source units are supported on the support member, and the space through which air flows is provided at the back surface side of each base member. Therefore, by arranging the plural light source units around the axial line, the luminance (brightness) corresponding to a high output type lamp such as an HID lamp or the like can be achieved, and also heat from the light emitting element (a) and the mount board can be efficiently radiated from the back surface of the base member by the heat radiation structure without increasing the size of the lamp since the space through which air flows is provided at the back surface side of each base member. Accordingly, even when the output power of the light emitting element(s) is increased by using the light emitting element(s) as a light source, sufficient cooling performance can be achieved, and there can be provided a suitable lamp which is used for illumination (brightness) requiring high output power like an HID lamp in brightness and size.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Best Mode for Carrying Out the Invention

Embodiments according to the present invention will be described hereunder with reference to the drawings.

First Embodiment

Figure 1:
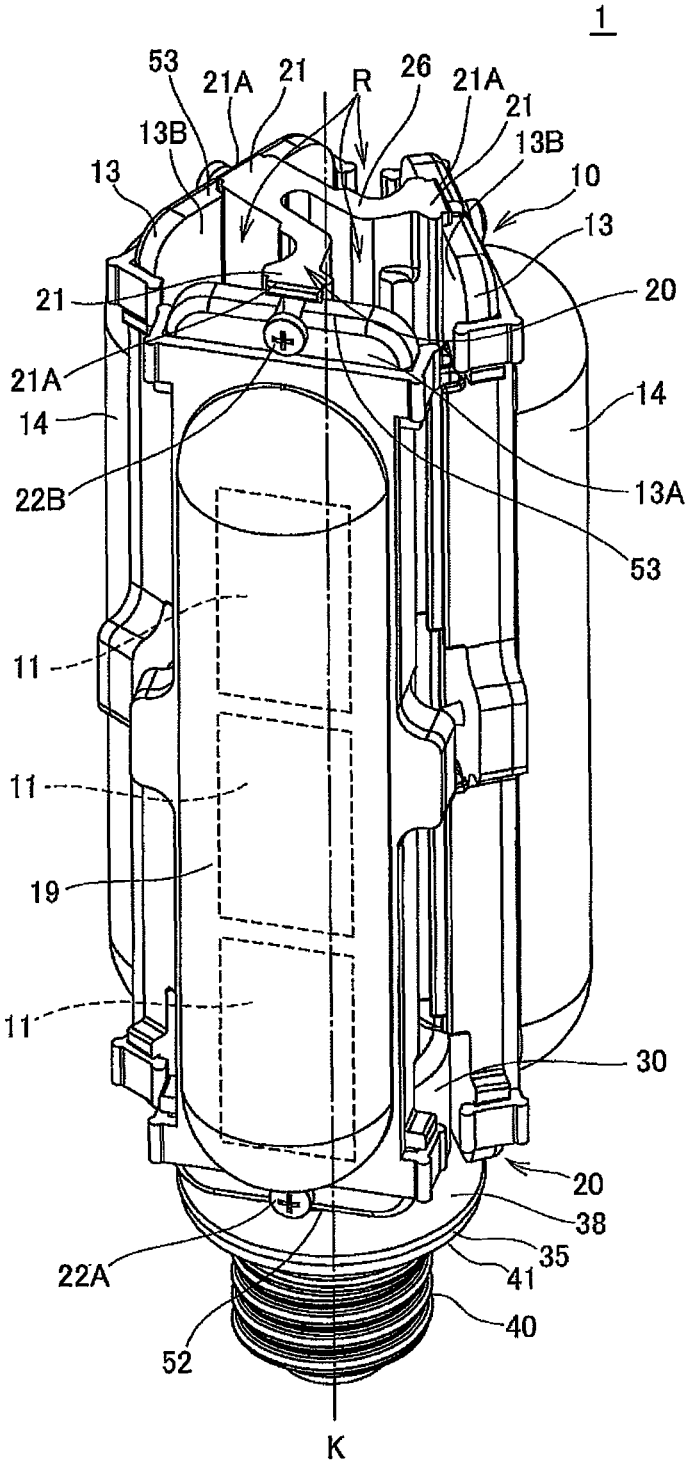
FIG. 1 is a perspective view showing the construction of an LED lamp according to an embodiment of the present invention.
Figure 2:
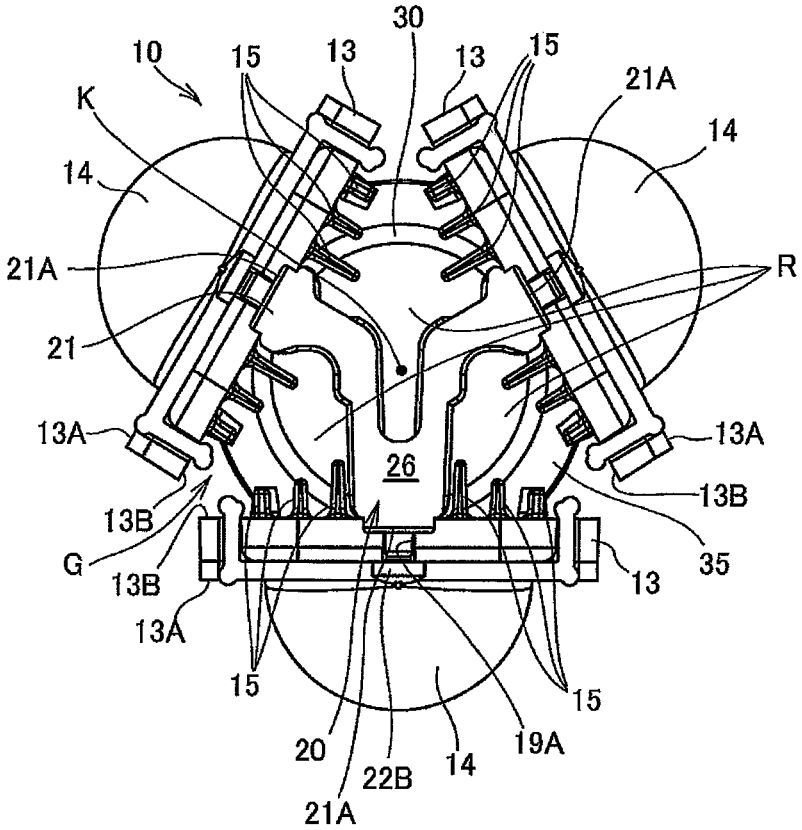
FIG. 2 is a plan view showing the construction of the LED lamp.
Figure 3:
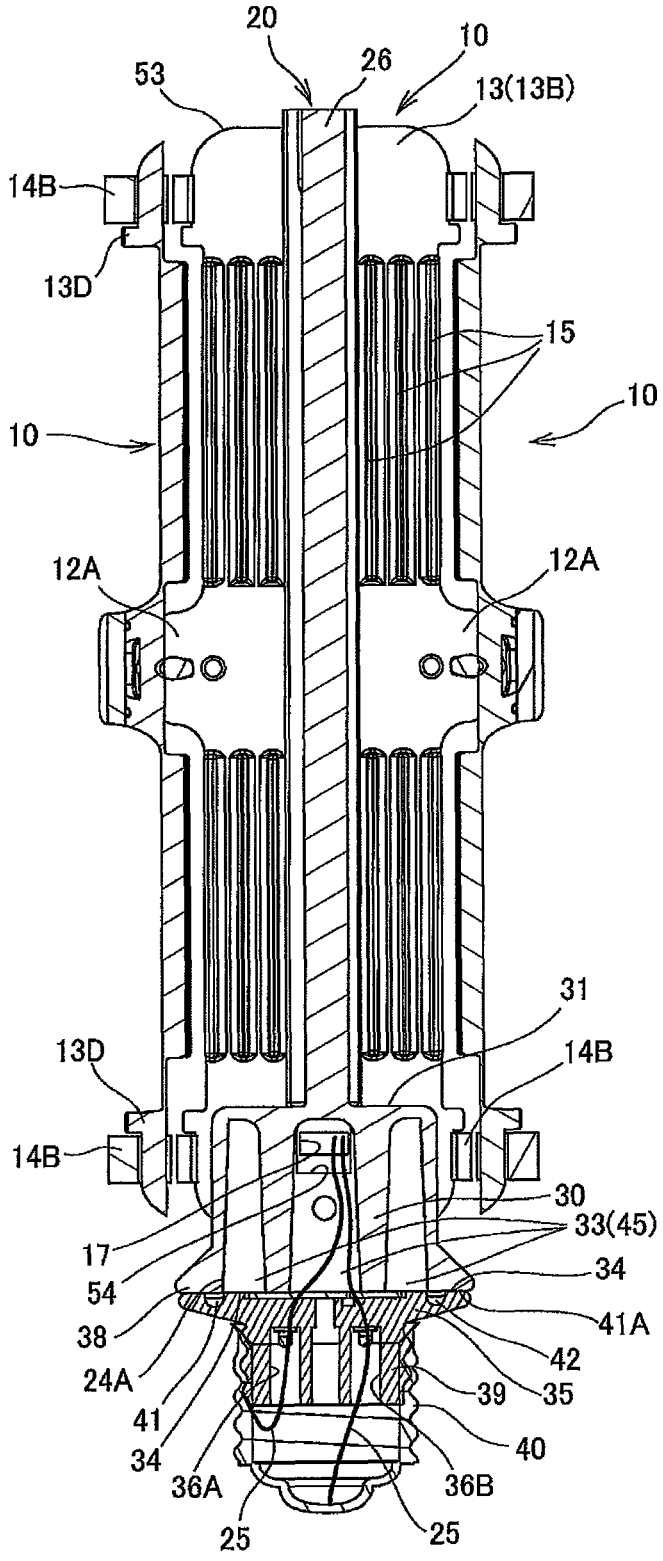
FIG. 3 is a cross-sectional view showing the construction of the LED lamp.
Figure 4:
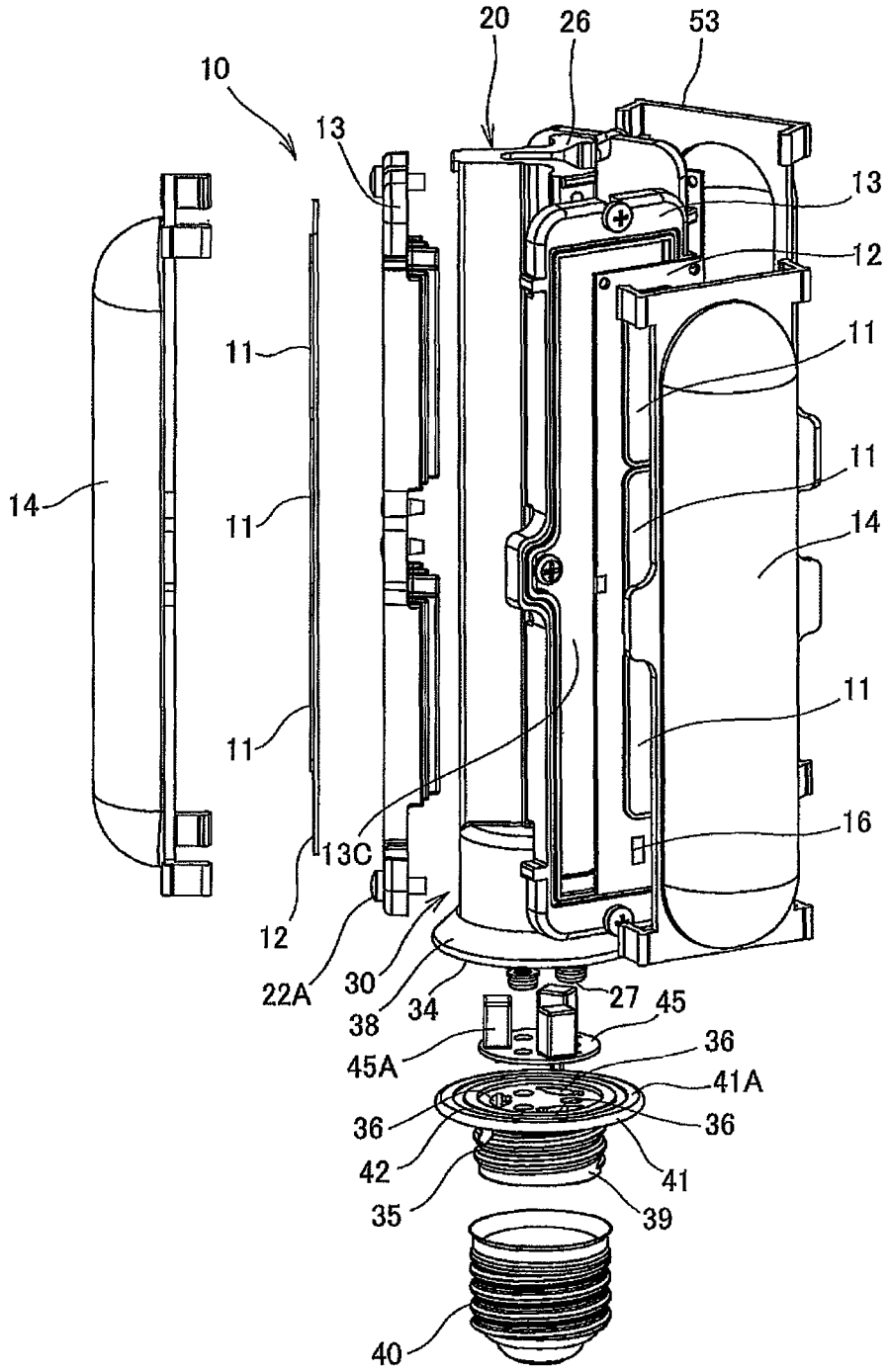
FIG. 4 is an exploded perspective view showing the construction of the LED lamp.

FIGS. 1 to 4 are diagrams showing the construction of an LED lamp 1 according to an embodiment, wherein FIG. 1 is a perspective view, FIG. 2 is a plan view, FIG. 3 is a cross-sectional view and FIG. 4 is an exploded perspective view.

As shown in FIG. 1, the LED lamp 1 is a base type lamp having a base 40 in which LED 11 as an example of a light emitting device is used as a light source, and the base 40 is usable while mounted in an existing socket. The LED lamp 1 extends like a rod as in the case of a light-emitting tube of an HID lamp, and radiation light is substantially uniformly emitted from the whole periphery of the LED lamp 1. In addition, the LED lamp 1 has high output power to the extent that it is used in place of a high output power type existing discharge lamp such as an HID lamp. The LED lamp 1 is waterproofed to be usable outdoors.

Although discharge lamps are turned on with AC power, the light emitting devices such as LED, etc. are turned on with DC power. Accordingly, when LED lamp 1 using LED 11 as a light source is turned on by an AC commercial power supply, DC power is supplied to the LED lamp 1 through a power supply circuit for converting the commercial power supply to DC power. The LED lamp 1 according to this embodiment is not provided with any power supply circuit, a power supply circuit is provided to a socket side, and DC power is input from the socket through the base. In other words, when this LED lamp 1 is mounted on a lamp fitting for an existing discharge lamp, it is used while a stabilizer provided to the lamp fitting is replaced by a power supply circuit.

Next, the construction of the LED lamp 1 will be described in detail.

As shown in FIGS. 1 to 4, the LED lamp 1 has the base 40, a support member 20 extending vertically to the base 40 like a column, a fixing member 35 for fixing the base 40 to the lower end portion of the support member 20, and plural (three in this embodiment) light source units 10 which are circumferentially supported by the support member 20. The base 40 is designed as a screw-in type (turn-in type) which is generally called as an E type base such as E26 type, E39 type or the like, for example. The base 40 is configured in conformity with an existing size, and can be screwed and mounted in an existing socket. DC power is supplied from the socket (not shown) to the base 40, and supplied to the respective light source units 10 in series. A plug-in type base may be used as the base 40.

Figure 5:
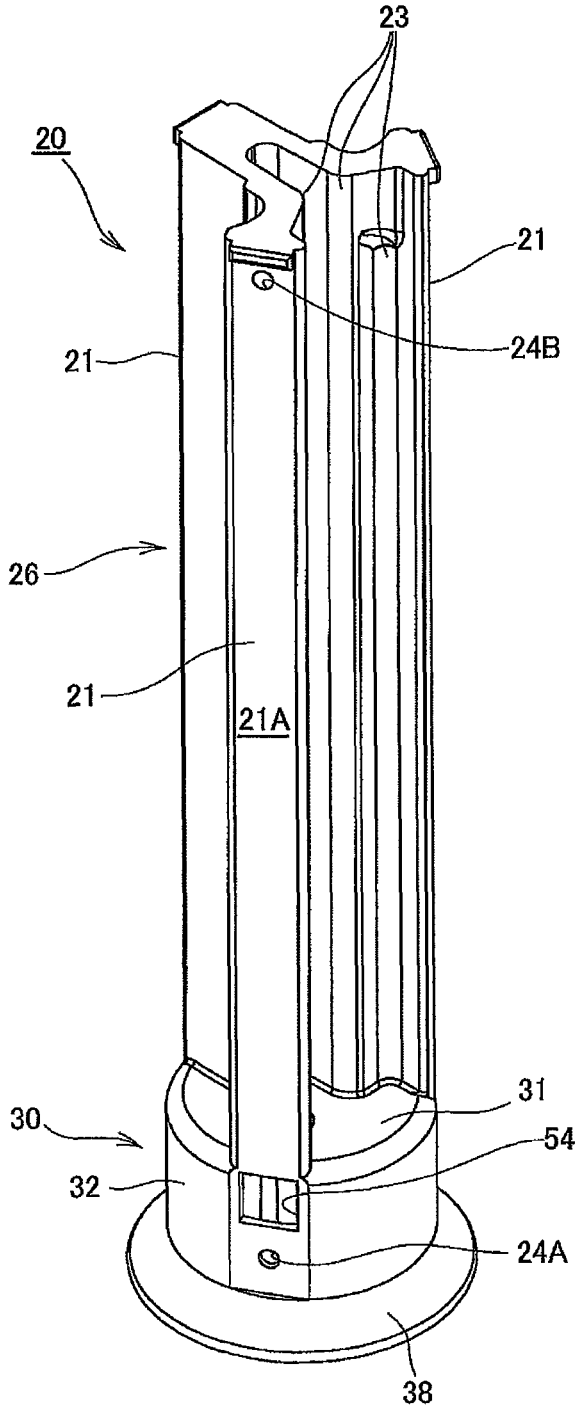
FIG. 5 is a perspective view showing the construction of a support member.

FIG. 5 is a perspective view showing the construction of the support member 20.

The support member 20 serves as a member for supporting the light source units 10 and connecting a lead wire 25 extending between the light source units 10 and the base 40 to the light source units 10 and the base 40 without exposing the lead wire to the outside, and has a storage body 30 and a column body 26.

The storage body 30 is designed in a substantially cylindrical shape, and screw holes 24 for fixing the light source units 10 by screws are formed in the outer peripheral surface of the storage body 30. Lead-in holes 54 for leading the lead wire 25 are formed at positions which are above the screw holes 24 and displaced from the screw holes 24 upwardly (to the upper surface 31 side). The screw holes 24 whose number corresponds to the number of the light source units 10 to be supported are formed at equal intervals around an axial line K corresponding to the center axis of the storage body 30. That is, the light source unit 10 is fixed in each screw hole 24 by the screw 22A, whereby the light source units 10 are supported at equal intervals around the axial line K. As described later in detail, the light source unit 10 is designed in a substantially rectangular parallelepiped shape in plan view, and the end portion at the lower end side thereof is fixed by the screw 22A, whereby the light source unit 10 is supported while cantilevered so as to extend upwards substantially in parallel to the axial line K. The other end portion (the other end) 53 at the upper end side of the light source unit 10 is supported on the column body 26 by a screw 22B, whereby the light source unit 10 is supported on the support member 20 at both the end portions at the lower and upper end sides thereof.

The surrounding portion around the screw hole 24 and the lead-in hole 54 on the outer peripheral surface 32 of the storage body 30 is shaped so as to come into close contact with the back surface shape (planar shape) of the light source unit 10. Accordingly, under the state that the light source unit 10 is screwed and supported in the screw hole 24, the back surface of the light source unit 10 covers the lead-in hole 54 under such a sealed state that the back surface of the light source unit comes into close contact with the surrounding portion around the lead-in hole 54. Therefore, the lead wire 25 is led out from the back surface side of the light source unit 10 and led into the storage body 30 through the confronting lead-in hole 54, whereby the lead wire can be extended between the light source unit 10 and the storage body 30 without being exposed to the outside.

The column body 26 functions to compensate for support of the light source unit 10 cantilevered by the storage body 30. The column body 26 is designed in a post-like shape so as to extend along the axial line K of the storage body 30 and integrally provided to the storage body 30 coaxially with the axial line K. The column body 26 supports the light source unit 10 so as not to come into close contact with the whole back surface of the light source unit 10, but so as to expose most of the back surface of the light source unit 10. Specifically, the column body 26 is designed in such a shape that the respective end portions of substantially plate-like arms (projecting portions) 21 whose number corresponds to the number of the light source units 10 to be supported (three in this embodiment) are joined to one another (substantially Y-shape in cross-section in this embodiment), and the respective arms 21 are spaced from one another at equal intervals so as to radially extend around the axial line K.

The column body 26 is erectly provided on the upper surface 31 of the storage body 30 so that the screw holes 24 and the lead-in holes 54 are located in the extension direction of the respective arms 21, and when the light source unit 10 is secured to the storage body 30 while oriented so as to extend upwards, the arms 21 is located on the back surface of the light source unit 10 concerned. The face at the tip side of each arm 21 confronts the back side of the light source unit 10, and this face functions as a flat contact face 21A to come into close contact with the back surface of the light source unit 10. A screw hole 24B is formed at the end portion at the upper end side of the contact face 21A, and the end portion at the upper end side of the light source unit 10 is fixed in the screw hole 24B by the screw 22B.

Here, the support member comprising the column body 26 and the storage body 30 is formed of material having excellent thermal conductivity, for example, aluminum alloy material by extrusion molding, and the arms 21 of the column body 26 have plural heat radiation fins 23 extending along the surfaces extending in the longitudinal direction. The back surface of the light source unit 10 comes into close contact with the contact face 21A of each arm 21, so that heat of the light source unit 10 is transferred to the arm 21 and efficiently radiated from the heat radiation fins 23. The shape of the heat radiation fins 23 provided to the arms 21 may be arbitrary, and the heat radiation fins 23 are formed in an uneven shape on the arms 21.

The arm 21 of the support member 20 is configured so that the center portion of the contact face 21A thereof is slightly higher than both the end portions thereof in the longitudinal direction, that is, the arm 21 is configured in an arcuate shape inside view so that a face thereof with which a contact portion 51 of the back side of the light source unit 10 described later comes into contact is slightly curved. That is, both the end portions at the lower end side and upper end side in the longitudinal direction of the light source unit 10 are screwed to the support member 20 by the screws 22A, 22B. The press force of pressing both the ends to the support member 20 is applied to both the ends by this screwing, and thus the light source unit 10 is liable to be warped in an arcuate shape in side view so that both the end portions of the light source unit 10 are nearer to the support member 20 side than the center portion 55 (see FIG. 8) of the light source unit 10. The contact face 21A of the arm 21 is formed to be curved in the longitudinal direction so as to come into contact with the warped portion of the light source unit 10 when the light source unit 10 is screwed, so that the close contact between the arm 21 and the light source unit 10 is enhanced, and heat of the light source unit 10 can be efficiently transferred to the support member 20 and radiated.

As shown in FIG. 5, a flange portion 38 protruding outwardly and circumferentially is formed at the edge portion of the bottom surface side of the outer peripheral surface 32 of the storage body 30, and a fixing member 35 for fixing the base 40 is joined to the bottom surface 34 of the flange portion 38 in a watertight style as shown in FIG. 3.

Specifically, as shown in FIGS. 3 and 4, the fixing member 35 is integrally provided with a column portion 39 having a substantially columnar shape and a flange portion 41 which is provided at the edge portion of the upper end side of the columnar portion 39 so as to protrude outwards and circumferentially. A ring groove 42 in which an O-ring (not shown) is mounted for waterproof is provided along the edge portion on the upper surface 41A of the flange portion 41, and the upper surface 41A of the flange portion 41 of the fixing member 35 is joined to the bottom surface 34 of the flange portion 38 of the storage body 30 by a screw, adhesive agent or the like while the upper surface 41 and the bottom surface 34 are brought into close contact with each other, thereby establishing waterproof. That is, the bottom surface 34 of the storage body 30 is blocked by the base 40, whereby the storage body 30 is waterproofed.

The base 40 is crowned on the column portion 39 of the fixing member 35 from the lower side. A pair of lead wires 25, 25 for positive potential and negative potential which are led from the light source unit 10 into the storage body 30 are passed through the fixing member 35 and electrically connected to the base 40.

Specifically, a male connector 27 is secured to the tip of each of the lead wires 25, 25. An interconnection path 33 is provided in the storage body 30 so as to intercommunicate with each lead-in hole 54, extend to the bottom surface 34 of the storage body 30 and be opened there. Female connectors 45A mounted on a board 45 having a pattern formed thereon are inserted in the respective intercommunication paths 33. Wires from mount boards 12 of the respective light source units 10 are connected to the female connectors 45A through lead-out holes 17 and lead-in holes 54, put together on the pattern of the board 45 on which the female connectors 45A are mounted, connected to one another in series and led to the fixing member 35.

As shown in FIG. 4, lead-in paths 36 connected to the respective intercommunication paths 33 of the storage body 30 are also formed in the fixing member 35, and the lead wires 25, 25 are introduced from the respective lead-in paths 36. Paths 36A and 36B through which the two lead wires 25, 25 are led out from the bottom surface are formed in the fixing member 35, and the lead wires 25, 25 lead out through the respective paths 36A, 36B are connected to the base 40.

According to this construction, the wiring connection workability from the respective light source units 10 to the base 40 can be enhanced, and the storage body 30 in which the wires are stored can be miniaturized.

Accordingly, each light source unit 10 and the base 40 are electrically connected to each other through the lead wires 25, 25, and each light source unit 10 is turned on with DC power supplied through the base 40. At this time, the lead wires 25, 25 are led from the light source units 10 into the support member 20 through the lead-in hole 54 and the lead-out hole 17 (described later) provided at the place where the light source unit 10 and the support member 20 (more accurately the storage body 30) are brought into face-to-face close contact with each other, so that the lead wires 25, 25 can be prevented from being exposed to the outside of the lead-in hole 54 and the lead-out hole 17 and thus water proof can be established therebetween.

In other words, by providing the light source units 10 and the support member 20 which are waterproofed, the perfect waterproof of the LED lamp 1 can be achieved.

Figure 6:
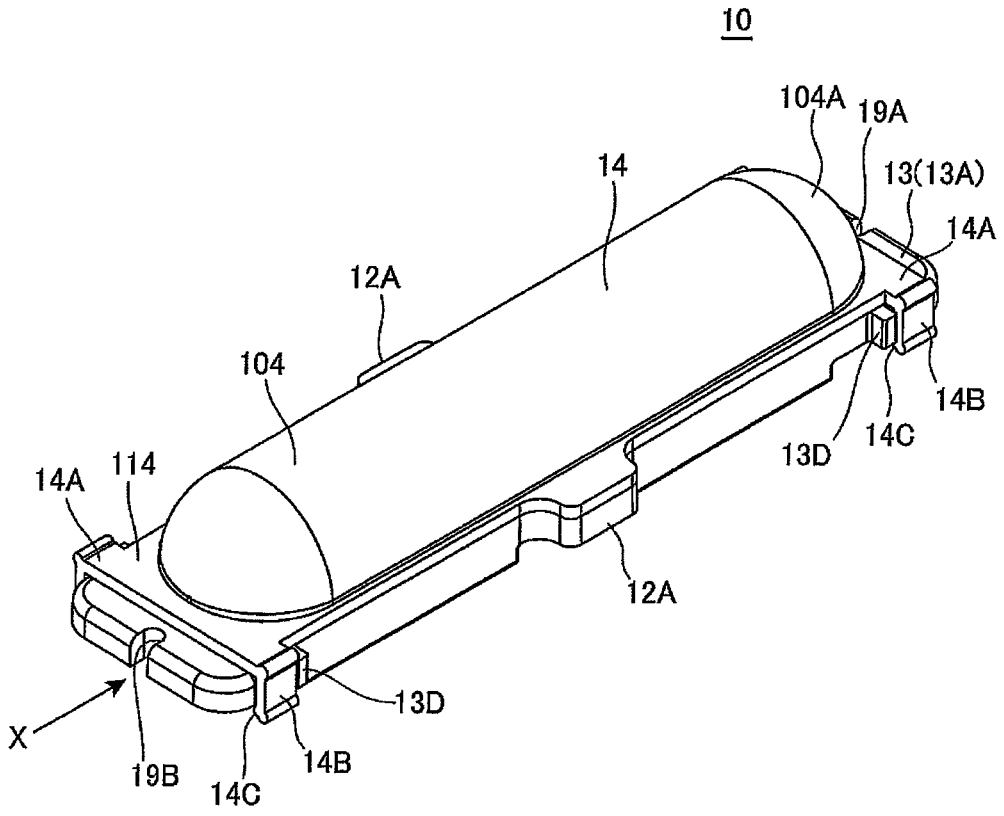
FIG. 6 is a perspective view showing the construction of a light source unit.
Figure 7:
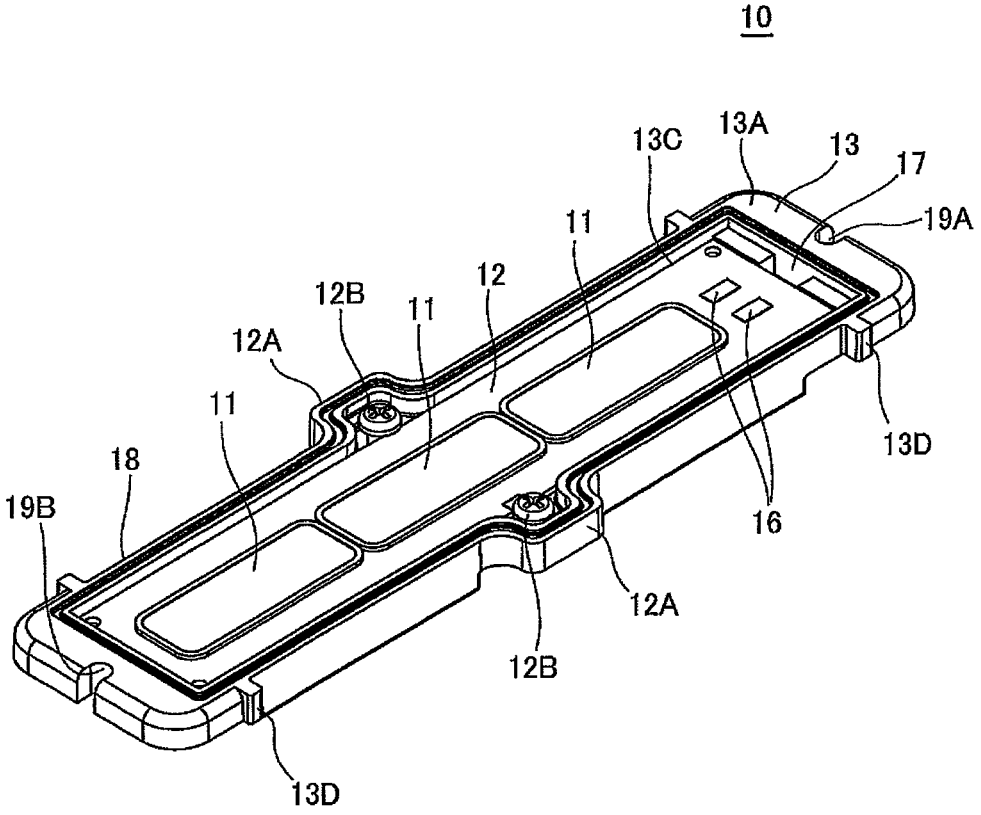
FIG. 7 is a perspective view showing the inside of the light source unit from which a waterproof cover is detached.
Figure 8:
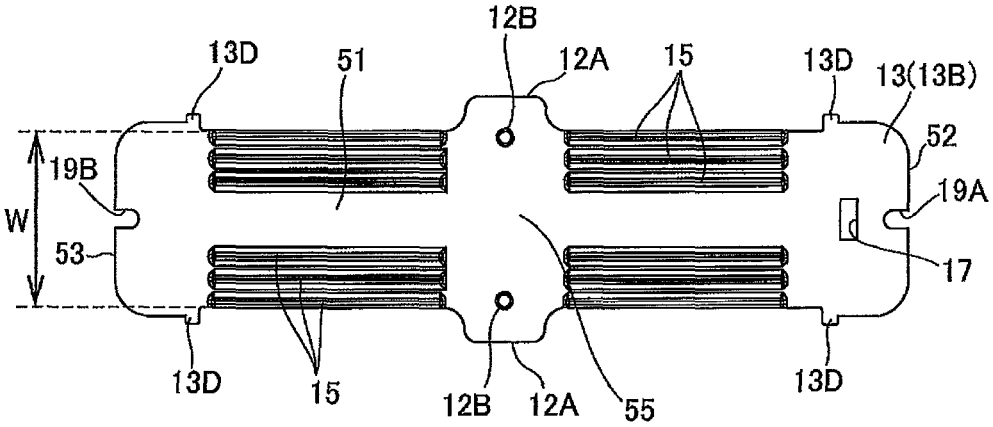
FIG. 8 is a back view showing the light source unit.

FIG. 6 is a perspective view showing the construction of the light source unit 10, and FIG. 7 is a perspective view showing the inside of the light source unit 10 from which a waterproof cover 14 is detached. FIG. 8 is a back view showing the light source unit 10.

The light source unit 10 uses LED 11 as a light source for emitting radiation light as described above, and it is modularized in a rectangular shape so as to extend along the axial line K of the support member 20.

LED lamp 1 according to this embodiment has three light source units 10, and the light source units 10 are arranged annularly around the axial line K of the support member 20 so as to extend in the same direction as the axial line K and be spaced from one another at equal intervals while the back surfaces 13B of base members 13 thereof face to the inside of the LED lamp 1, and supported by the support member 20, whereby light is emitted to the whole circumferential range around the axial line K.

All the light source units 10 have the same structure and shape. When LED lamps 1 different in optical output power are constructed, light source units whose number corresponds to desired optical output power are arranged circumferentially on the support member 20.

In this LED lamp 1, when the light source units 10 are arranged around the axial line K, a gap G is provided between the adjacent light source units 10. This will be described later.

The construction of the light source unit 10 will be described in detail. As shown in FIG. 4 and FIGS. 6 to 8, the light source unit 10 has the mount board 12 on which LEDs 11 is mounted, and the base member 13 having a surface 13A on which the mount board 12 is secured through an electrically insulating member (not shown).

The mount board 12 is a substantially rectangular print wiring board, and plural LEDs 11 and an electrode pattern 16 to which the lead wires 25, 25 are soldered to constitute a charging portion are provided on the surface of the mount board 12.

LED 11 is formed by arranging many LED elements, 240 LED elements (in this embodiment) like a grid in a substantially rectangular range in plan view and molding them with resin material of a small thickness. The substantially whole surfaces thereof emit light. As shown in FIG. 7, plural (three in an illustrative example) LEDs 11 are arranged in series on the mount board 12 with substantially no gap therebetween, and linear light emission can be obtained by these LEDs 11. As described above, LED 11 comprises many LED elements, and is configured so as to emit light from the whole body thereof. Therefore, the light emission area is large, and an effect of loosening glare is achieved.

Furthermore, the occupancy rate of the LEDs 11 to the surface area of the mount board 12 is more than the majority, and the light source unit 10 is designed so that the surface of the mount board 12 wholly emits light.

The electrode pattern 16 is formed at the end portion of the mount board 12, and electrically connected to each LED 11 in series or in parallel through print wiring (not shown).

The base member 13 is formed into a rectangular plate by conducting extrusion molding on a metal material having high thermal conductivity such as aluminum or the like, and functions as a base member for packaging the mount board 12 and a heat sink which receives heat of LED 11 and radiate the heat.

More specifically, as shown in FIG. 7, the base member 13 is designed in the form of a thin plate (having flat front and back surfaces) having such a size that the mount board 12 can be mounted in the base member 13, and a mount portion 13C as a recess portion in which the mount board 12 is mounted substantially all over the surface thereof is formed on the surface 13A of the base member 13. As shown in FIG. 4, the mount portion 13C is designed in a flat shape so as to come into close contact with the mount board 12, thereby enhancing the thermal conduction from the mount board 12 to the base member 13.

Swollen portions 12A which swell outwards in a short direction of the base member 13 are formed at the substantially center portions of both the side surfaces in the short direction, and a screw 12B is fixed to each of the swollen portions 12A to fixedly press the mount board 12 mounted on the mount portion 13C.

As shown in FIG. 7, the lead-out hole 17 which penetrates through the base member 13 to the front and back surfaces thereof and leads the lead wires 25, 25 connected to the mount board 12 to the back surface side is formed at one end portion (one end) 52 side nearer to the electrode pattern 16 of the mount board 12 in the mount portion 13C of the base member 13. A notch 19A for passing therethrough a screw 22A to be screwed into the storage body 30 of the support member 20 is provided to the one end portion 52 nearer to the lead-out hole 17. Furthermore, a notch 19B for passing therethrough a screw 22B to be screwed into the arm 21 of the support member 20 is likewise provided to the other end portion 53 of the base member 13. The base member 13 is fixed to the support member 20 at both the end portions 52, 53 by the screws.

The lead-out hole 17 is provided so as to intercommunicate with the lead-in hole 54 of the storage body 30 when the base member 13 is fixed to the support member 20. Accordingly, as described above, the lead wires 25, 25 connected to the electrode pattern 16 of the mount board 12 are led into the storage body 30 through the lead-out hole 17 and the lead-in hole 54 without being exposed to the outside.

The lead-out hole 17 opened to the back surface 13B of the base member 13 is sealed by a proper seal member, and thus the back surface 13B side is waterproofed.

The waterproof structure at the surface 13A side of the base member 13 will be described. As shown in FIG. 7, a groove 18 surrounding the mount portion 13C is formed on the surface 13A, and a waterproof packing (not shown) is inset in the groove 18. A waterproof cover 14 is secured so as to crush the waterproof packing as shown in FIG. 6. For the purpose of waterproofing between the surface 13A of the base member 13 and the waterproof cover 14, caulking agent may be filled in the groove 18 in place of inset of the waterproof packing.

The waterproof cover 14 has a dome-shaped cover portion 104A which is formed of a translucent material such as resin material and designed to be elliptical in plan view and semi-circular in cross-section. A flat-plate flange 114 is formed integrally with and around the cover portion 104 of the waterproof cover 14, and comes into contact with the surface 13A of the base member 13 so as to press the waterproof packing or caulking agent inset in the groove 18 against the surface 13A. Accordingly, the close contact between the flat-plate flange 114 and the waterproof packing in the groove 18 can prevent invasion of water into the inside mount portion 13C, and the mount board 12 and the charging portion can be protected from being immersed with water.

According to this construction, for example when the lamp 1 is wholly covered by a waterproof cover to make the light source unit 10 have a waterproof structure, no sufficient cooling effect is achieved because air convection stagnates. However, according to this embodiment, the waterproof structure is established by covering only LED 11 of each individual light source unit 1 and the mount board 12 having the LED 11 mounted thereon with a waterproof cover. Accordingly, the lamp 1 is configured so as to establish the waterproof structure of the LED 11 of each light source unit and the mount board 12 having the LED 11 mounted thereon and also expose the other parts to the outside, so that a high cooling effect can be achieved.

The above construction brings the light source unit 10 with the waterproof structure. The lead wires 25, 25 extending from the light source unit 10 is led into the support member 20 (storage body 30) from the lead-in hole 54 which is provided in the plane which is brought into close contact with the light source unit 10, and thus the waterproof structure of the whole LED lamp 1 can be easily established.

The fixing structure of the waterproof cover 14 to the base member 13 will be described. Each corner portion 14A of the flat plate flange 114 is provided with a hook portion 14B for hooking the waterproof cover 14 to the base member 13. The tip of each hook portion 14B is provided with a hook pawl 14C which is hooked to the back surface 13B of the base member 13 when the waterproof cover 14 is mounted on the surface 13A of the base member 13. When the waterproof cover 14 is secured to the base member 13, the hook portion 14B is elastically deformed and pressed until the hook pawl 14C is hooked to the back surface 13B of the base member 13 while the hook pawl 14C is brought into contact with the side surface of the base member 13. The side surface of the waterproof cover 14 is provided with a stopper 13D which is fitted to the hook portion 14B of the waterproof cover 14 to prevent the waterproof cover 14 from sliding in the longitudinal direction of the base member 13. According to this construction, the light source unit 10 can be waterproofed with a simple construction. Furthermore, the waterproof cover 14 can be simply secured to the base member 13 with neither a screw nor another member, so that the fabrication performance can be enhanced.

In this LED lamp 1, the optical output power of each LED element of LED 11 is increased and/or the number of LED elements is increased to obtain such high optical output power as obtained by an HID lamp or the like. Therefore, heat generation of each LED 11 is very high, and thus the light source unit 10 using the LED 11 as a light source is required to have high heat radiation performance (cooling performance). Particularly, with respect to the base type LED lamp 1, a heat generation treatment is required to be performed by the LED lamp 1 itself unlike a lamp fitting or the like, and thus it has been hitherto difficult to increase the output power.

Therefore, according to this embodiment, the heat radiation of the LED lamp 1 is enhanced as follows.

That is, in the light source unit 10, the mount board 12 is provided in close contact with the surface 13A of the base member 13 formed of a material having high thermal conductivity, and many heat radiation fins 15 are integrally provided to the back surface 13B of the base member 13, so that heat generated in the LED 11 of the mount board 12 is radiated through the heat radiation fins 15.

More specifically, the contact face 21A of the arm 21 of the support member 20 comes into contact with the back surface 13B of the base member 13. The width of the contact face 21A is sufficiently smaller than the width W of the back surface 133 of the base member 13 (about one third in this embodiment), and the residual part is exposed. In this embodiment, the contact face 21A of the arm 21 comes into contact with the substantially center portion of the back surface 13B of the base member 13 along the longitudinal direction, and every three heat radiation fins 15 extending in parallel to the arm 21 are provided at each of both the sides of the center portion. These heat radiation fins 15 are provided between the stoppers 13D provided at both the ends of the base member 13 to prevent the displacement of the waterproof cover 14, more accurately, between each swollen portion 12A and each stopper 13D. That is, every three heat radiation fins 14 are provided at each of four sections so as to be apart among the four sections.

The three heat radiation fins 15 of each section comprise three heat radiation fins different in height so that the height thereof is lower from the inside (the arm 21 side) to the outside as shown in FIG. 2. According to this construction, the heat of LED 11 can be efficiently radiated by increasing the heat radiation area in the neighborhood of LED 11 provided on the surface 13A of the base member 13, and the light source unit 10 can be more greatly reduced in weight as compared with a case where all the heat radiation fins are formed to have the same size.

When the light source unit 10 described above is supported on the arm 21, the arm 21 comes into contact with the light source unit 10 at the contact face 21A whose width is smaller than the width W of the light source unit 10, so that spaces R extending along the axial line K of the support member 20 are formed at the back surface 13B sides of the respective base members 13 among the base members 13 and the support member 20 as shown in FIG. 2. The space R functions as a ventilation path which extends from the upper end of the back surface 13B of each light source unit 10 to the lower end thereof and intercommunicates with the outside. Accordingly, the heat generated in LED 11 can be sufficiently radiated from the heat radiation fins 15 of the back surface 13B of each light source unit 10. In other words, the light source unit 10 has the capabilities of sufficiently radiating the heat generated in LED 11 by itself. Therefore, there can be constructed an LED lamp 1 which is provided with sufficient heat radiation capabilities without relying on heat transfer to the support member 20 side. Accordingly, any material can be selected for the support member 20 irrespective of the thermal conduction performance thereof, and thus inexpensive material can be used, so that's the cost can be reduced.

Of course, by forming the support member 20 containing the arms 21 of high thermal conduction material, the heat generated in the light source unit 10 can be transferred to the support member 20 to assist the heat radiation, so that higher heat radiation performance can be achieved.

Furthermore, as described above, the light source units 10 are arranged around the axial line K of the support member 20 so as to be spaced from one another through the gaps G. The gap G intercommunicates with the space R, and air easily flows through the space R. Accordingly, the heat radiation from the heat radiation fins facing the space R is enhanced.

As described above, according to the LED lamp 1 of this embodiment, the following effects can be achieved.

That is, the lamp of this embodiment has the plural flat plate type light source units 10 that respectively have the mount board 12 having the LEDs 11 mounted on the surface 13A of the base member 13 and are arranged around the axial line K while the back surfaces 13B of the base members 13 face inwards, and the support member 20 provided on the axial line K, wherein the plural light source units 10 are supported on the support member 20 and the space R through which air flows is provided at the back surface 13B side of each base member 13.

Since the plural light sources 10 are arranged around the axial line K, the same level of luminance as a high output type lamp such as an HID lamp can be achieved. Furthermore, the LEDs 11 and the mount board 12 having the LEDs 11 mounted thereon are unitized as a light source unit 10. Therefore, the output power of the LED lamp 1 can be changed by changing the number of light source units 10 to be used, and thus LED lamps 1 which are different in luminance and correspond to HID lamps, for example, of 100 W, 200 W, 300 W and 400 W can be manufactured by using common light source units 10. Furthermore, the light source units 10 of the LED lamp 1 are respectively modularized, and thus the light source units 10 can be exchanged every unit under maintenance, so that the maintenance performance of the LED lamp 1 can be enhanced. Still furthermore, the plural light source units 10 are mounted on the support member 20 while the back surfaces 13B of the respective base members 10 face inwards, and the space R through which air flows is provided at the back surface 13B side of each base member 13. Therefore, the heat radiation structure in which the heat generated from the LEDs 11 and the mount board 12 can be efficiently radiated from the back surface 13B of the base member 13 can be achieved without increasing the size of the LED lamp 1. Therefore, there can be provided the LED lamp 1 which uses LEDs 11 as light sources and can serve as an alternative for a high output type HID lamp in luminance and size. In addition, the light source units 10 can be used as common parts, and LED lamps which are different in output power can be easily manufactured at low cost.

Furthermore, according to this embodiment, the plural heat radiation fins 15 are provided on the back surface 13B of the base member 13, and the light source unit is mounted on the support member 20 so that air flows among the heat radiation fins 15, so that the heat of the LEDs 11 on the surface 13A of the base member 13 and the heat of the mount board 12 can be efficiently radiated. Furthermore, the heat radiation area of the back surface 13B of the base member 13 can be increased, and also air flowing between the support member 20 and the back surface 13B of the base member 13 flows among the heat radiation fins 15, so that heat can be efficiently radiated from the light emitting elements 11 provided on the surface 13A of the base member 13 and the mount board 12.

According to this embodiment, the base 40 is provided to the storage body 30, and thus the LED lamp 1 can be connected to a socket of an existing lamp fitting through the base 40, and the LED lamp 1 can be easily used as an alternative for an HID lamp or the like without changing the socket of the lamp fitting or the lamp fitting.

According to this embodiment, the light source unit 10 has the waterproof cover 14 for covering the mount board 12. For example when the whole lamp 1 is covered by a waterproof cover to establish the waterproof structure in the light source unit 10, air convection stagnates, and thus no sufficient cooling effect is achieved. However, according to this embodiment, only LEDs 11 and the mount board 12 having the LEDs 11 mounted thereon in each individual light source unit 10 are covered by the waterproof cover to establish the waterproof structure. Accordingly, in the lamp 1, the waterproof structure of the LEDs 11 and the mount board 12 having the LEDs 11 mounted thereon is established in each light source unit 10, and also the other parts of the light source unit 10 are exposed to ambient air, so that a high cooling effect can be achieved.

Furthermore, according to this embodiment, the support member 20 is provided with the plural heat radiation fins 23. Therefore, the support member 20 has a large heats radiation area, so that heat transferred from the light source unit 10 to the support member 20 can be efficiently radiated from the support member 20.

Still furthermore, according to this embodiment, one end portions (one ends) 52 of the plural light source units 10 are supported on the storage body 30, and the other end portions 53 are supported at the tip of the support member 20 extending from the storage body 30, so that the light source units 10 can be stably supported.

According to this embodiment, the projecting portions 21 are provided to the support member 20, and the light source units 10 are supported on the projecting portions 21. Therefore, the space through air flows can be provided between the support member 20 and the back surface 13B of the base member 13. Furthermore, the number of light source units 10 to be supported on the support member 20 can be changed by providing any number of projecting portions 21 to the support member 20. Therefore, the light source units 10 can be made as common parts, and LED lamps 1 different in output power can be easily manufactured at low cost.

Still furthermore, according to this embodiment, the projecting portions 21 extend in the longitudinal direction of the support member 20, and the back surface 13B of the base member 13 comes into contact with the projecting portion 21, so that heat of the light source unit 10 can be transferred through the projecting portions 21 from the back surface 13B to the support member 20 and radiated. Therefore, the heat radiation structure for transferring the heat from the LEDs 11 and the mount board 12 from the back surface 13B of the base member 13 to the support member 20 and efficiently radiating the heat can be formed without increasing the size of the LED lamp 1.

According to this embodiment, since the center portion of the arm (projecting portion) 21 is higher than both the end portions thereof with respect to the longitudinal direction of the support member 20, the arm (projecting portion) 21 is configured so that the contact face 21A of the arm 21 is formed to be curved in the longitudinal direction and the light source unit 10 comes into close contact with the warpage of the support member 20 when the light source unit 10 is screwed to the support member 20. Therefore, the close contact between the arm 21 and the light source unit 10 is enhanced, and the heat of the light source unit 10 can be efficiently transferred to the support member 20 and radiated.

Furthermore, according to this embodiment, the projecting portions 21 are radially provided to the support member 20, plural support members 20 in which projecting portions 21 are different in number are prepared, the plural light source units 10 have the same shape, and the number of light source units 10 to be secured to the support member 20 is changed, whereby the output power of the lamp 1 is changeable. Accordingly, the light source units 10 can be provided as common parts, LED lamps 1 which are different in output power can be easily manufactured at low cost, and the maintenance performance of the LED lamps 1 can be enhanced.

Second Embodiment

Figure 9:
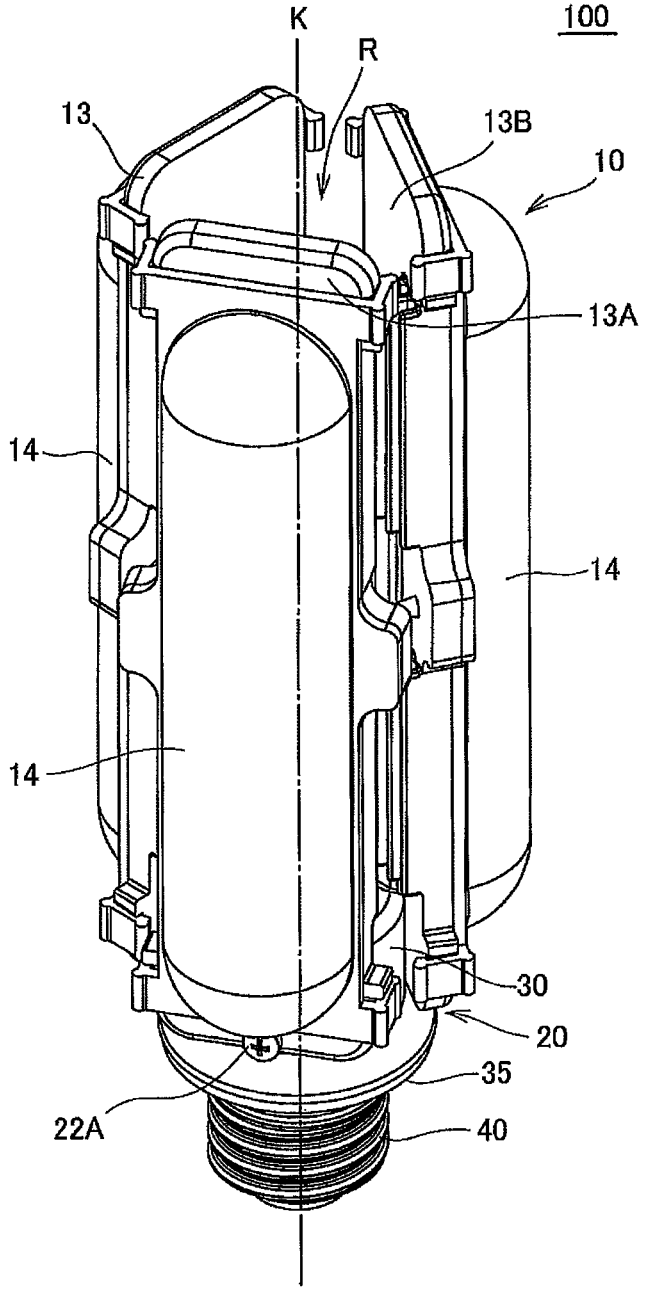
FIG. 9 is a perspective view showing the construction of an LED lamp according to a second embodiment of the present invention.
Figure 10:
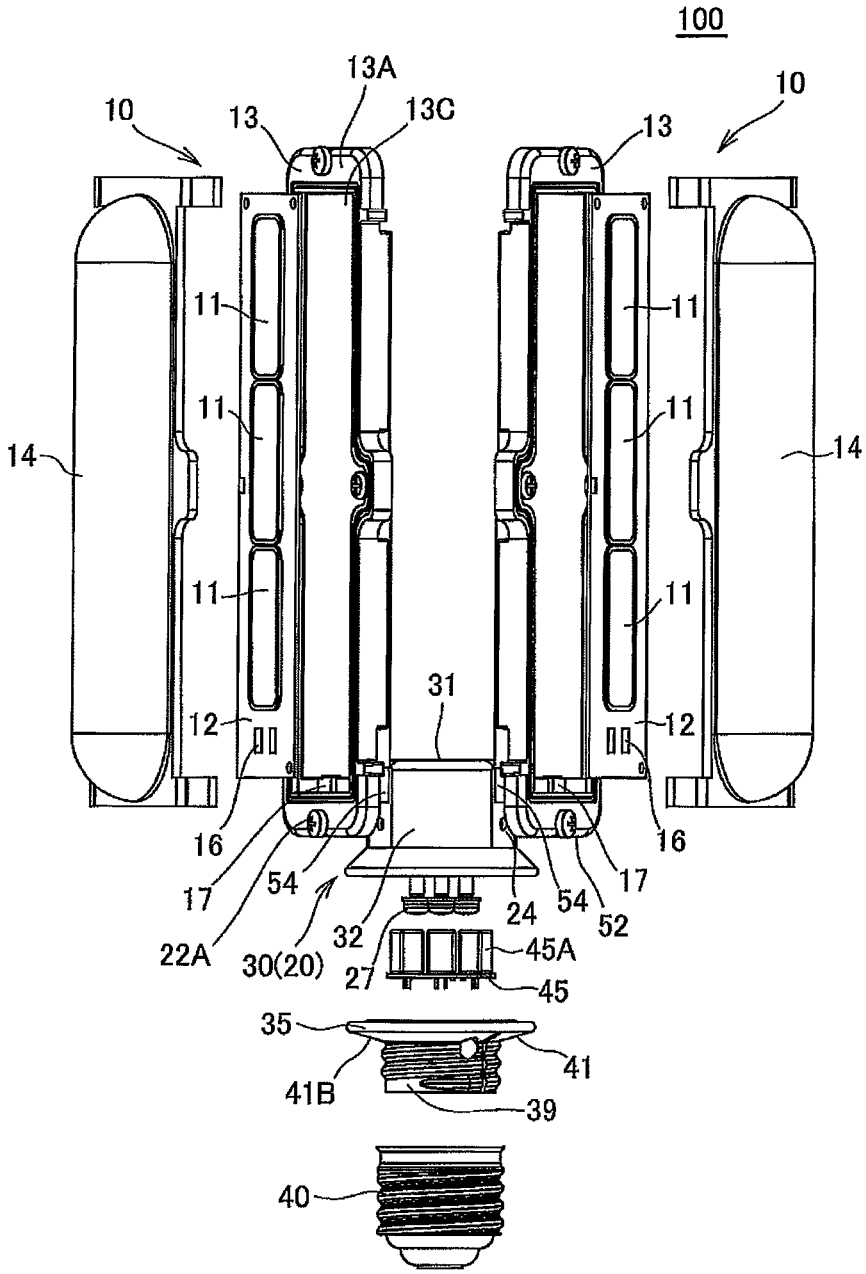
FIG. 10 is an exploded perspective view showing the LED lamp.

In the above-described first embodiment, both the end portions 52, 53 of the light source unit 10 is straddle-mounted on the periphery of the support member 20 comprising the storage body 30 and the column body 26. However, the support member 20 may be configured so that the column body 26 is omitted. In this embodiment, a cantilever structure that the light source unit is supported on the periphery of the support member 20 comprising only the storage body 30, that is, cantilevered to the storage body 30 will be described FIG. 9 is a perspective view showing the construction of an LED lamp 100 according to this embodiment, and FIG. 10 is an exploded perspective view showing the LED lamp 100. In these figures, the same constructions as the LED lamp 1 of the first embodiment are represented by the same reference numerals, and the descriptions thereof are omitted.

As shown in FIGS. 9, 10, the light source unit 10 is cantilevered to the storage body 30 around the axial line K at one end portion 52 thereof.

Figure 11:
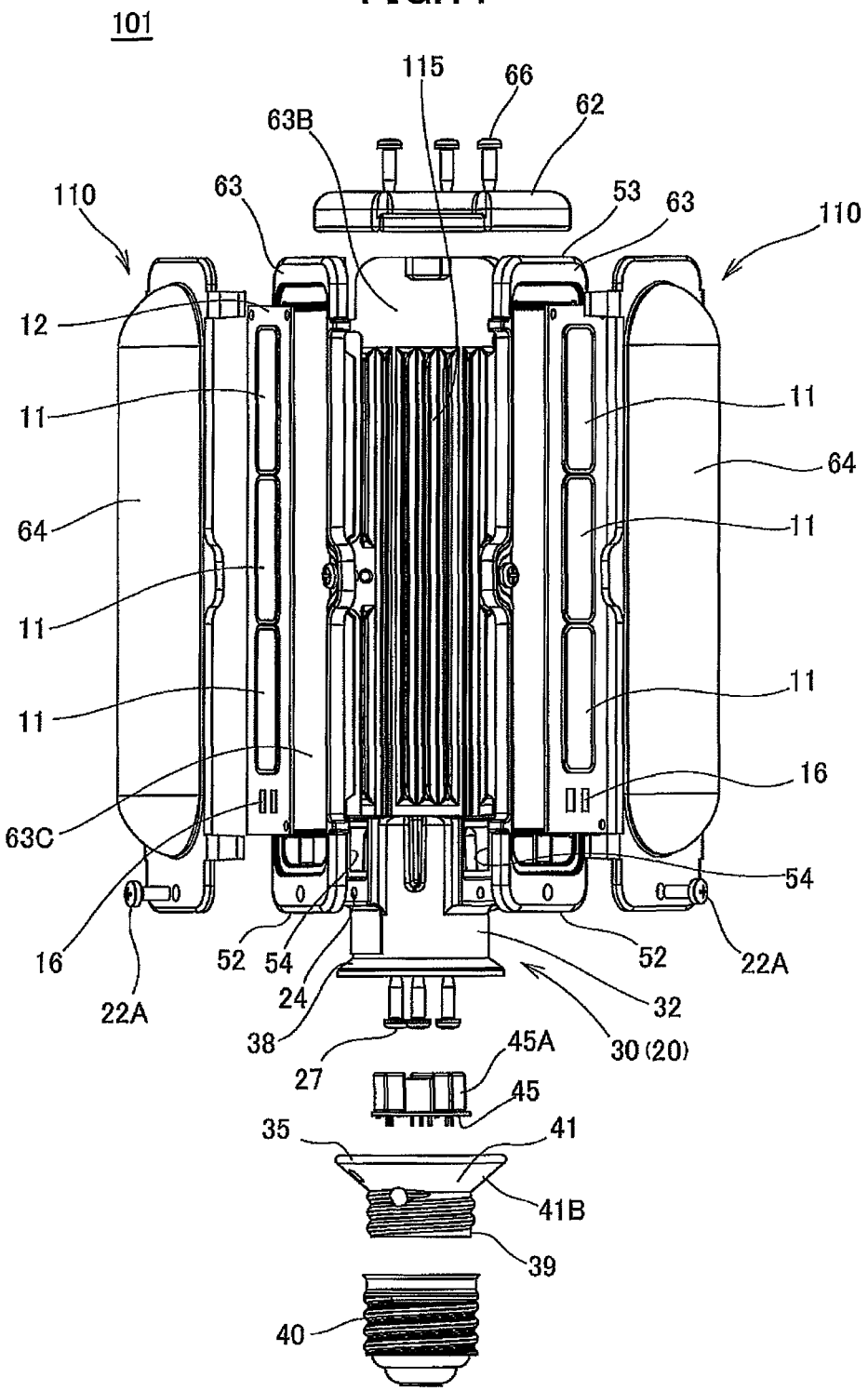
FIG. 11 is an exploded perspective view showing the construction of an LED lamp according to a modification of the second embodiment.

According to this construction, the weight of the LED lamp 100 can be reduced, a broad space R can be provided at the back surface 13B side of the base member 13 of the light source unit 10, and much air can be made to flow through this space R. Accordingly, the heat radiation efficiency from the back surface 13B side of the base member 13 can be increased, and the heat from the LEDs 11 and the mount board 12 which are provided to the light source unit 10 can be efficiently radiated. When one end portion 52 of the light source unit 10 is cantilevered to the periphery of the storage body 30, the whole back surface 13B of the base member 13 can be set as a heat radiation face. As shown in FIG. 11, heat radiation fins extending in the longitudinal direction of the back surface 13B may be provided to the back surface 13B of the base member 13 so as to be arranged in the short direction without any gap therebetween, whereby the heat radiation area of the back surface 13B can be increased.

FIG. 11 is a diagram showing an LED lamp 101 according to a modification of the second embodiment. As shown in FIG. 11, in the LED lamp 101, plural light source units 10 are provided so that one end portions 52 thereof are cantilevered to the periphery of the storage body 30 and the other end portions 53 of the light source units 10 are joined and fixed to one another by the joint member 62. A joint member 62 will be described in detail in a third embodiment described below.

The LED lamp 101 has a taper face 41B which is formed at the flange portion 41 of the fixing member 35 so as to be tapered at a predetermined angle with respect to the column portion 39. The angle of the taper face 41B with respect to the column portion 39 is set to any angle which can enhance the workability when the base 40 is fixed to the fixing member 35 by soldering.

Third Embodiment

As described above, in the first embodiment, the light source unit 10 is configured so that one end portion 52 thereof is supported on the storage body 30 and the other end portion 53 is supported on the column body 26 extending along the axial line K from the upper surface of the storage body 30. The column body 26 has the plate-shaped arms 21 extending radially around the axial line K, and the light source units 10 are supported while the arms 21 are brought into close contact with the back surfaces of the light source units 10. The LED lamp 1 may be used not only for vertical lighting with the axial line K set in the vertical direction, but also for horizontal lighting with the axial line K set in the horizontal direction.

Heat convects from the lower side to the upper side. Therefore, when the LED lamp 1 is set to perform the horizontal lighting, convection of heat radiated from the light source unit 10 disposed at the lower side under the horizontal lighting operation is prevented by the column body 26, and thus the heat cannot be efficiently radiated. Furthermore, the column body 26 is heated by heat radiated from the light source unit 10 disposed at the lower side under the horizontal lighting operation, and also the heat is transferred to the light source unit 10 through the arm 21. Still furthermore, the column body 26 is formed of a metal material, which increases the total weight of the whole LED lamp 1.

In the LED lamp 1, the LEDs 11 are arranged in the axial direction of the column body 26, and thus the center of gravity of the LED lamp 1 is shifted to the tip side. Therefore, when the LED lamp 1 set for the horizontal lighting suffers vibration or the like, an overload is imposed on the base 40 or the socket which is located far away from the position of the center of gravity. Particularly with respect to a high output power type LED lamp 1 using plural light source units 10, there may occur such a problem that the amount of radiated heat is large, and the total weight is also large, so that the lifetime of the light source units at the upper side is shortened by heat or the base or the socket is damaged under the horizontal lighting operation.

The third embodiment aims to solve the problem of the above-described technique and provide an LED lamp 102 which is light in weight and excellent in heat radiation efficiency. In the following description, the same constructions as the LED lamp 1 of the first embodiment are represented by the same reference numerals, and the descriptions thereof are omitted.

Figure 12:
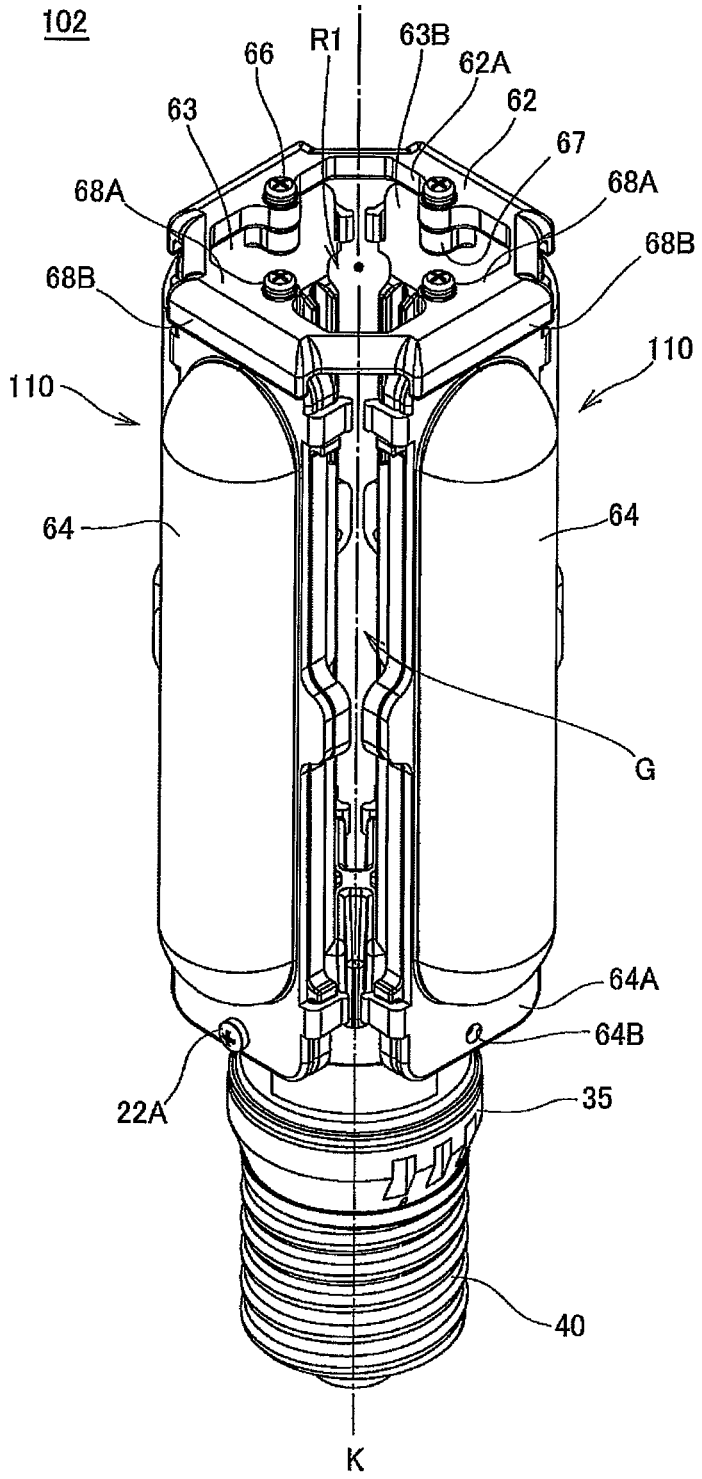
FIG. 12 is a perspective view showing the construction of an LED lamp according to a third embodiment of the present invention.
Figure 13:
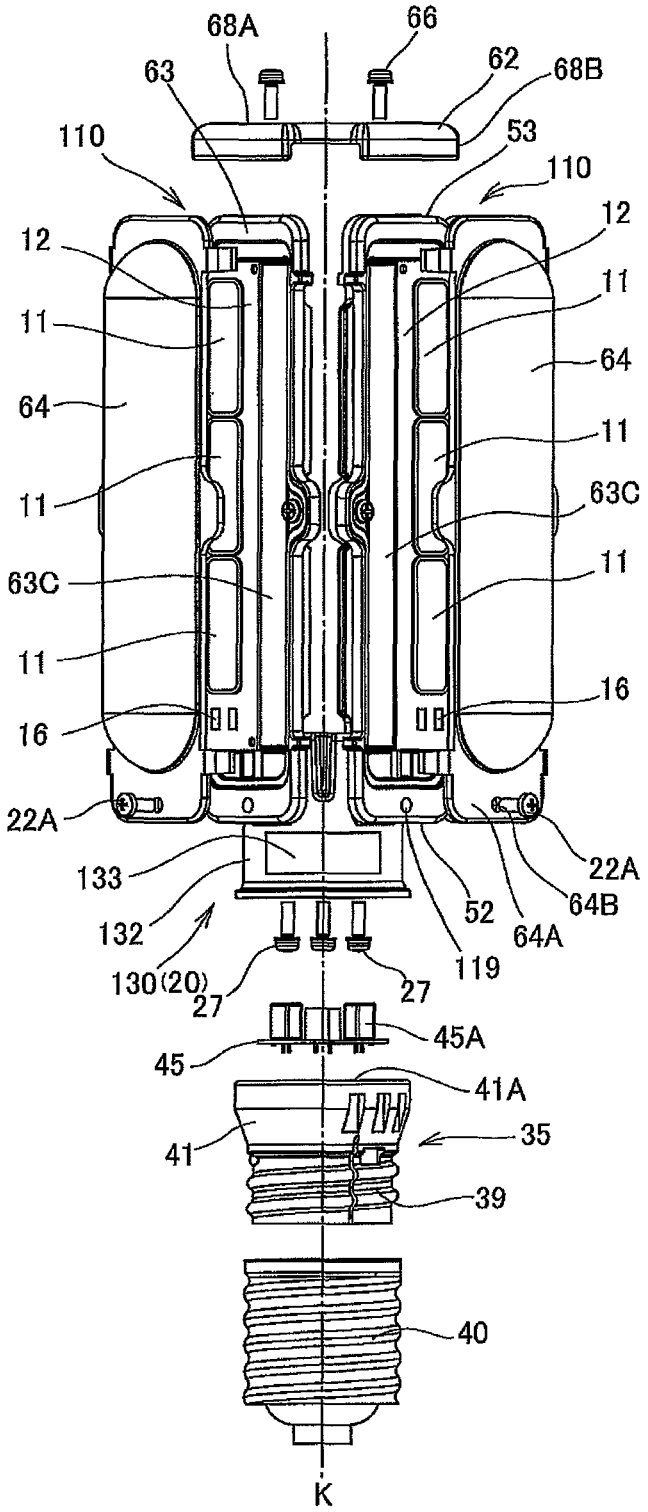
FIG. 13 is an exploded perspective view showing the LED lamp.

FIG. 12 is a perspective view showing the construction of an LED lamp 102 according to a third embodiment, and FIG. 13 is an exploded perspective view showing the LED lamp 102.

As shown in FIGS. 12 and 13, the LED lamp 102 has a base 40, a storage body 130 provided vertically to the base 40, a fixing member 35 for fixing the base 40 to the lower end portion of the storage body 130, and plural (four in this embodiment) light source units 10 supported on the periphery of the storage body 130. The storage body 30 is constructed as a supporter for supporting the light source units, and also serves as a member for connecting lead wires (see FIG. 3) extending among the light source units 110 and the base 40 without exposing the lead wires 25 to the outside.

The storage body 130 is designed in a substantially cylindrical shape. Screw holes 24 in which the light source units 110 are screwed are formed on the outer peripheral surface 132 of the storage body 130, and lead-in holes 54 in which the lead wires 25 are led are formed at positions displaced upwards (to the upper surface 31 side) from the lead-in holes 54 (see FIG. 11). The screw holes 24 whose number corresponds to the number of light source units 110 to be supported are formed at equal intervals around the axial line K as the center axis of the storage body 130. That is, the light source units 110 are fixed in the screw holes 24 by screws 22A, whereby the light source units 110 are supported at equal intervals around the axial line K. Furthermore, the storage body 130 is configured in a cylindrical shape so that the length between the screw hole 24 and the flange portion 38 is equal to a predetermined length, and a name plate area 133 on which a model number, etc. are written is provided on the outer peripheral surface 132 between the screw hole 24 and the flange portion 38.

The light source unit 110 is designed in a substantially rectangular parallelepiped shape in plan view. One end portion 52 of the lower end side of the light source unit 110 is fixed to the storage body 130 by a screw 22A, and it is cantilevered while extending upwards substantially in parallel to the axial line K. The other end portions 53 of the plural light source units 110 which are opposite to the one end portions 42 are joined to one another by a joint member 62.

The joint member 62 is formed of a metal material having excellent rigidity or the like. The joint member 62 is designed in a polygonal annular (ring-like) shape to join the other end portions 53 which are opposite to the one end portions 52 of the plural light source units 110, and has an opening 62A through which a space R1 described later intercommunicates with the outside in the direction of the axial line K. The joint member 62 may be designed in a plate-like shape having at least one opening in place of the ring-like shape. The joint member 62 is beforehand formed to have such a shape that the other end portions 53 of the light source units 110 which are fixed to the periphery of the storage body 130 at the one end portions 52 thereof are fixed to predetermined positions. Furthermore, the joint member 62 is formed to have such a strength that it is not deformed even when a load caused by the weight of the light source units 110 is continuously imposed under the horizontal lighting operation of the LED lamp 102 or the like.

The joint member 62 has end face press portions 68A which come into planar contact with the upper end faces of the respective light source units 110, and outer periphery press portions 68B for pressing the respective light source units 110 from the outer peripheral side. The joint member 62 is fixed to the light source units 110 from the opening 62A side by screws 66 which are threaded from the other end portion side into screw fixing portions 67 protruded from the back surfaces 63B of the light source units 110.

According to this construction, the other end portions 53 of the light source units 110 are mutually joined to one another and supported by the joint member 62, so that the strength of the LED lamp 102 can be more greatly enhanced as compared with the construction that the respective light source units 110 are fixed and supported by only the storage body 130. For example, when the light source units 110 are fixed to the storage body 130 by only the screws 22A, the light source units 110 may warp outwards due to repulsive force or the like of O-ring described later (not shown) which is interposed among the light source units 110 and the storage body 130. In this embodiment, the other end portions 53 which are opposite to the one end portions 52 screwed by the screws 22A are joined to one another and supported by the joint member 62, whereby the warpage of the light source units 110 can be prevented. Furthermore, the light source units 110 can be positioned by joining the light source units 110 with the joint member 62, so that the light source units 110 can be supported in parallel to the axial line K of the storage body 130.

The light source unit 110 radially emits radiation light by using the LEDs 11 as a light source, and is configured to be modularized in a rectangular shape extending along the axial line K of the storage body 130. In the LED lamp 102, the plural light source units 110 are arranged annularly at equal intervals around the axial line K while the plural light source units 110 extend in the same direction as the axial line K of the storage body 130 and the back surfaces 63B of the respective base members 63 thereof face inwards. Accordingly, light is emitted over the whole periphery of the axial line K. All the light source units 110 are configured to have the same construction and the same shape, and when LED lamps 102 different in optical output power are constructed, the light source units 110 whose number corresponds to desired optical output power are arranged around the storage body 130.

Figure 15:
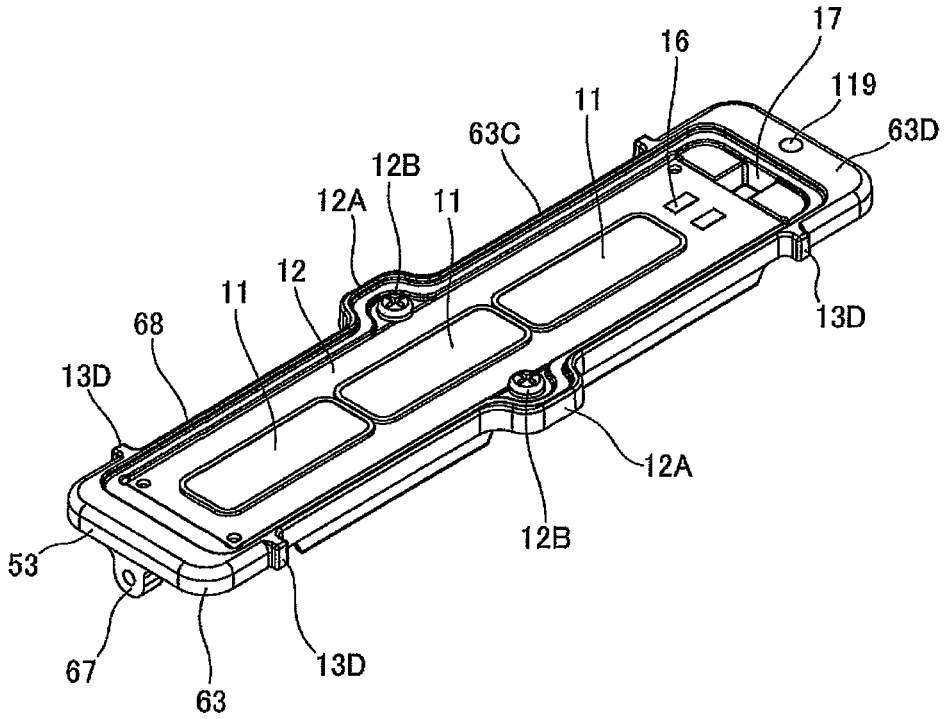
FIG. 15 is a perspective view showing the inside of the light source unit.

The light source unit 110 has the mount board 12 having the LEDs 11 mounted thereon, and the base member 63 having the surface 63A to which the mount board 12 is secured through an electrically insulating member (not shown). The base member 63 is configured in a rectangular plate-like shape by conducting extrusion molding on a metal material having high thermal conductivity such as aluminum or the like, for example, and functions as a base for packaging the mount board 12 and a heat sink for receiving heat generated in the LEDs 11 and radiating the heat. More specifically, as shown in FIG. 15, the base member 63 is formed like a thin plate (a plate having flat front and back surfaces) so as to have such a size that the mount board 12 can be accommodated therein. The mount portion 63C as the recess portion in which the mount board 12 is accommodated substantially in plane is formed on the surface 63A of the base member 63. The mount portion 63C is configured in a planar shape which enables the close contact with the mount board 12, and heat transfer from the mount board 12 to the base member 63 can be enhanced.

Figure 16:
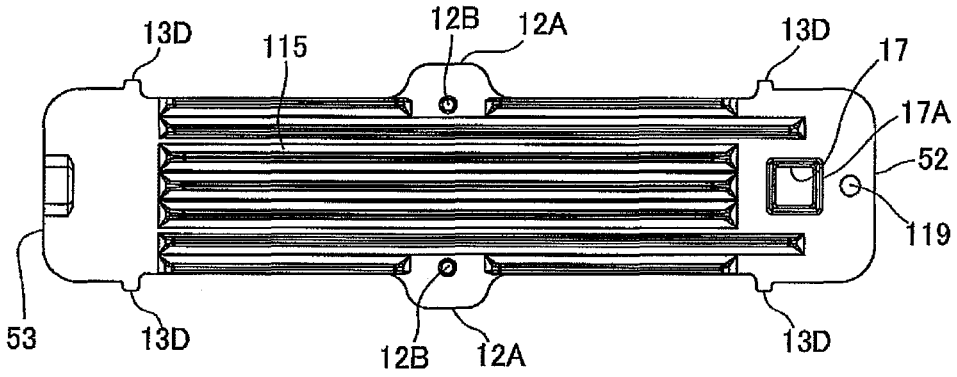
FIG. 16 is a back view of the light source unit.

With respect to the outer peripheral surface 132 of the storage body 130, the peripheries of the screw hole 24 and the lead-in hole 54 are shaped so as to be close contact with the back surface shape of the light source unit 10. Furthermore, as shown in FIG. 16, a wall portion 17A protruding along the outer periphery of the lead-out hole 17 is provided to the back surface 63B of the base member 63, and an O-ring (not shown) is annularly mounted around the wall portion 17A. Under the state that the light source unit 110 is screwed in the screw hole 24 and supported, the wall portion 17A is inserted in the lead-in hole 54, the O-ring is crashed between the back surface 63B of the base member 63 and the outer peripheral surface 132 of the storage body 130, and the back surface 63B of the light source unit 110 covers the lead-in hole 54 in a seal state under which the back surface 63B of the light source unit 110 comes into close contact with the periphery of the lead-in hole 54. Accordingly, the lead wires 25 are led out from the back surface 63B side of the light source unit 110 and led into the storage body 130 through the confronting lead-in hole 54, whereby the lead wires 25 can be extended between the light source unit 110 and the storage body 130 without being exposed to the outside.

Figure 14:
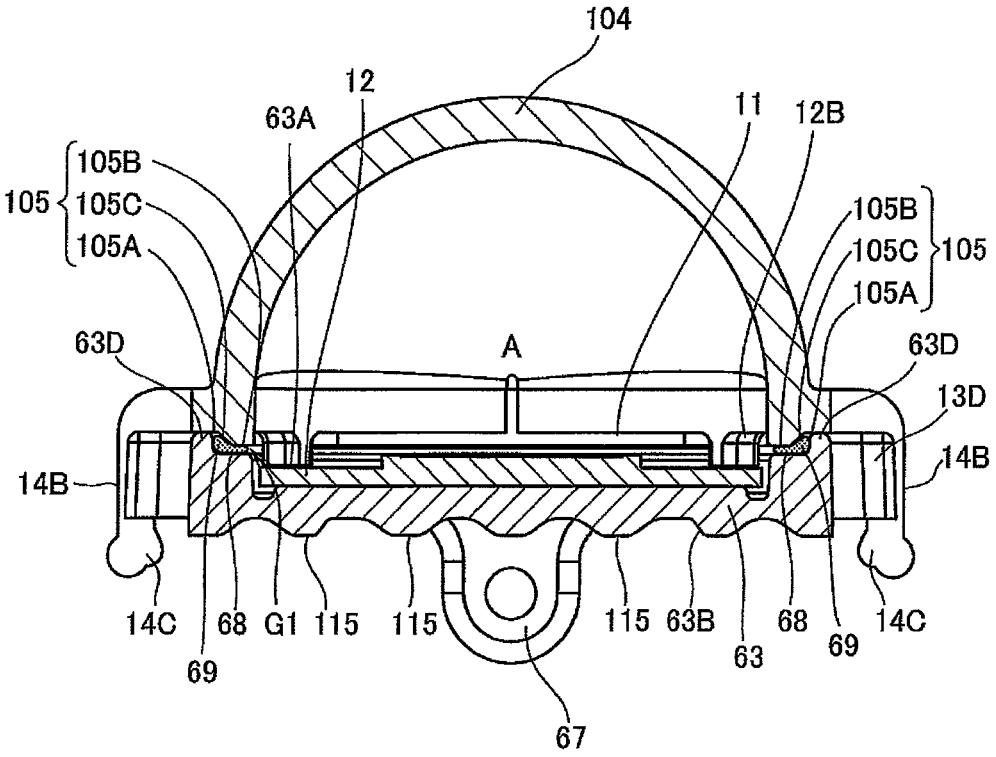
FIG. 14 is a cross-sectional view showing the light source unit.

The waterproof structure at the surface 63A side of the base member 63 will be described. As shown in FIG. 15, a filling groove 68 is formed on the surface 63A so as to surround the mount portion 63C. As shown in FIG. 14, the filling groove 68 is filled with caulking agent 69 for waterproof, and the waterproof cover 45 is secured to the surface 63A of the base member 63 while the gap between the surface 63A of the base member 63 and the waterproof cover 64 is filled with the caulking agent 69. Accordingly, the waterproof between the waterproof cover 64 and the surface 63A of the base member 63 can be kept, invasion of water into the mount portion 63C at the inside of the light source unit 110 can be prevented, and the mount board 12 and the charging portion can be protected from being immersed with water.

The waterproof cover 64 has a dome-shaped cover portion 104 which is formed to be elliptical in plan view and semicircular in cross-section by using a translucent material such as resin material, for example. A flange portion 105 is provided around the cover portion 104 of the waterproof cover 64. A first flange portion 105A which comes into planar contact with the outer peripheral edge 63D of the base member 63 and a second flange portion 105B which is provided along the inner edge of the cover portion 104 and forms a gap between the filling groove 68 and the flange portion 105 are provided at the bottom surface side of the flange portion 105. The second flange portion 105B allows the gap G1 formed between the waterproof cover 64 and the surface 63A of the base member to intercommunicate with a space A formed inside the light source unit 110 by the base member 63 and the waterproof cover 64. Furthermore, a joint portion 105C between the first flange portion 105A and the second flange portion 105B is tapered at the position corresponding the step between the outer peripheral edge 63D of the base member 63 and the filing groove 68.

According to this construction, when the waterproof cover 64 is covered on the base member 63, the caulking agent 69 filled in the filling groove 68 is dammed by the outer peripheral edge 63D and prevented from protruding to the outside of the light source unit 110. Furthermore, the tapered joint portion 105C is provided at the position corresponding to the step between the outer peripheral edge 63D and the filling groove 68 on the flange portion 105 of the waterproof cover 64. Therefore, a pooling portion of caulking agent is provided along the outer peripheral edge 63D in the filling groove 68, whereby the waterproof at the surface 63A side of the base member 63 can be surely performed. Furthermore, the second flange portion 105B allows the gap G1 formed between the waterproof cover 64 and the base member surface 63A to intercommunicate with the space A inside the light source unit 110. Therefore, even when the coating amount of the caulking agent 69 coated in the filling groove 68 is dispersed and thus protrudes from the filling groove 68 because of an excessive amount of the caulking agent 69, the caulking agent 69 does not protrude to the outside of the light source unit 110, but protrudes to the inside of the light source unit 110, so that the appearance of the light source unit 110 is not impaired.

According to this construction, for example when the whole LED lamp 102 is covered by a waterproof cover to establish the waterproof structure in the light source unit 110, convection of air stagnates and thus a sufficient cooling effect cannot be achieved. However, according to this embodiment, only LEDs 11 and the mount board 12 having the LEDs 11 mounted thereof in each light source unit 110 are covered by the waterproof cover 64, whereby the waterproof structure is established. Accordingly, in the LED lamp 102, the waterproof structure for the LEDs 11 and the mount board 12 having the LEDs 11 mounted thereon in each light source unit 110 can be established, and also the other parts are configured to be exposed to the outside, so that a high cooling effect can be achieved.

The light source unit 110 having the waterproof structure is constructed by the above construction. The lead wires 25, 25 extending from the light source unit 110 are led into the storage body 130 through the lead-in hole 54 formed in the plane which is brought into close contact with the light source unit 110 and sealed, and thus the waterproof of the whole LED lamp 102 can be simply established.

Next, the fixing structure of the waterproof cover 64 to the base member 63 will be described. The waterproof cover 64 is provided with a hook portion 14B which is provided at each corner portion of the flange portion 105 to fix the waterproof cover 64 to the base member 63. The tip of each hook portion 14B is provided with a hook pawl 14C which is hooked to the back surface 63B of the base member 63 when the waterproof cover 64 is mounted on the surface 63A of the base member 63. When the waterproof cover 64 is secured to the base member 63, the hook portion 14B is elastically deformed, and the hook pawl 14C is pressed until the hook pawl 14C is hooked to the back surface 63B of the base member 63 while the hook pawl 14C is brought into contact with the side surface of the base member 63. The side surface of the base member 63 is provided with a stopper 13D which is fitted to the hook portion 14B of the waterproof cover 64 to prevent the waterproof cover 64 from sliding in the longitudinal direction.

As shown in FIGS. 12 and 13, one end portion 64A of the waterproof cover 64 is provided with a hole 643 in which a screw 22A for screwing the light source unit 110 to the storage body 130 is inserted. Accordingly, one end portion 64A of the waterproof cover 64 is screwed to the storage body 130 together with the base member 63 by the screw 22A.

The waterproof cover 64 is configured so that the end face of the other end portion 64C is substantially in plane with the end face of the other end portion 53 of the light source unit 110. The other end portion 64C of the waterproof cover 64 is pinched by the base member 63 and the outer periphery press portion 683 of the joint member 62 under the state that the other end portions 53 of the light source units 110 are joined to one another by the joint member 62 and the joint member 62 is fixed to the screw fixing portions 67 by the screws 66.

According to this construction, the one end portion 64A of the waterproof cover 64 can be fixed to the base member 63 by the screw 22A, and also the other end portion 64C thereof can be held from the periphery thereof by the joint member 62. As described above, both the end portions 64A, 64C of the waterproof cover 64 can be held to the base member 63, so that the waterproof cover 64 can be prevented from releasing or dropping and the light source unit 110 can be surely waterproofed.

With respect to the LED lamp 102, the power of each LED element of the LED 11 is increased and/or the number of LED elements is increased to achieve high optical output power like HID lamp. Therefore, heat generated in each LED 11 is very high, the light source unit 110 using the LED 11 as a light source is required to have high heat radiation performance (cooling performance). Particularly, with respect to the base type LED lamp 102, increase of output power has been difficult because it is required for the LED lamp 102 to treat heat generation by itself unlike a lamp fitting or the like.

Therefore, in this embodiment, the heat radiation performance of the LED lamp 102 is enhanced as follows.

In the light source unit 110, many heat radiation fins 115 are integrally provided to the back surface 63B of the base member 63 formed of high thermal conductive material, and heat generated in the LED 11 of the mount board 12 is radiated through the heat radiation fins 115. A plurality of heat radiation fins 115 are arranged in parallel to one another in the width direction of the base member 63, and each heat radiation fin 115 extends in the longitudinal direction between the stoppers 13D of the base member 63.

The light source unit 110 is cantilevered to the periphery of the storage body 130 while the back surface 633 of the base member 63 faces inwards. The light source units 110 are arranged around the axial line K of the storage body 130 while the gap G is provided between the respective light source units 110. Accordingly, a space R1 which extends along the axial line K of the storage body 130 and intercommunicates with the gaps G is formed at the back surface 63B side of the base members 63. This space R1 extends from the upper end of the back surface 63B of each light source unit 110 to the lower end thereof, and intercommunicates with the outside, thereby functioning as a ventilation path. Heat radiated from the heat radiation fins 115 of the back surface 63B of each light source unit 110 to the space R1 is radiated through the gaps G and the opening 62A of the joint member 62 to the outside in the radial direction of the LED lamp 102 and in the direction of the axial line K.

As described above, according to this embodiment, one ends of the plural light source units 110 are cantilevered to the periphery of the storage body 130. According to this construction, the light source units 110 can be supported in the space R1 provided at the back surface 63B side of the light source units 110 without providing any member which intercepts flow of air through the space R1 such as the column body 26 and the arms 21 of the first embodiment, for example. Accordingly, even when the LED lamp 102 is set to perform the horizontal lighting, air can be made to easily flow through the space R1, and the heat radiation performance from the heat radiation fins 115 facing the space R1 is enhanced. Furthermore, the light source unit 110 can be cantilevered to the periphery of the storage body 130 without providing the column body 26 and the arm 21, whereby the total weight of the whole LED lamp 102 can be reduced. Still furthermore, the light source unit 110 can be cantilevered to the periphery of the storage body 130 without providing the column 26 and the arm 21, the position of the center of gravity of the LED lamp 102 can be provided to be near to the base 40, and an overload can be prevented from being imposed on the base 40 and the socket due to vibration applied to the LED lamp 102 or the like under the horizontal lighting operation.

Furthermore, according to this embodiment, the other ends (other end portions) of the plural light source units 110 are joined to one another by the joint member 62, and the joint member 62 is provided with the opening 62A through which the space R1 intercommunicates with the outside in the direction of the axial line K. According to this construction, the heat radiated from the heat radiation fins 115 on the back surface 63B of each light source unit 110 to the space R1 is outward radiated in the radial direction of the LED lamp 102 and the direction of the axial line K through the gaps G between the respective light source units 11 and the opening 62A of the joint member 62. Accordingly, air can be made to easily flow through the space R1, and the heat radiation performance from the heat radiation fins 115 facing the space R1 can be enhanced, so that the heat generated in the LED 11 can be sufficiently radiated.

Furthermore, according to this embodiment, the male connectors 27 are secured to the wires 25 from the plural light source units 10, and the board 45 in which the connectors 27 are inserted is provided in the storage body 30. Therefore, the wires from the mount boards 12 of the respective light source units 10 can be put together on the pattern of the board 45, and connected to one another in series, so that the workability of connecting the wires from the respective light source units 10 to the base 40 can be enhanced and the storage body 30 in which the wires are accommodated can be miniaturized.

According to this embodiment, the waterproof structure 14 for waterproofing the mount board 12 is provided on the surface 13A of the base member 13, the lead-out hole 17 for leading out the lead wires is provided to the back surface 13B of the base member 13, the support member 20 is provided with the lead-in hole 54 for leading the lead wires from the lead-out hole 17 into the support member 20, the lead-out hole 17 and the lead-in hole 54 are waterproofed by bringing the light source unit 10 and the support member 20 into close contact with each other, and the respective lead wires mounted in the storage body 30 are waterproofed by blocking the storage body 30. Accordingly, the mount board 12 is waterproofed, the lead-out hole 17 and the lead-in hole 54 through which the lead wires of the light source unit 10 are passed are waterproofed, and further the lead wires accommodated in the storage body 30 are waterproofed, whereby the lamp 1 can be configured as a waterproof type lamp. Therefore, the lamp 1 can be used for a lamp fitting installed outdoors.

Furthermore, according to this embodiment, the storage body 30 is provided with the base, and the storage body 30 is blocked by the base 40. Therefore, the lead wires accommodated in the storage body 30 can be waterproofed by the base 40, the base 40 can be connected to a socket of an existing lamp fitting, and the lamp 1 can be used as an alternative for HID lamp without changing the socket of the lamp fitting or the lamp fitting.

Furthermore, the storage body 30 is provided with the lead-in hole 54. Therefore, for example when the projecting portion 21 is provided with the lead-in hole to accommodate the lead wires in the storage body 30, the projecting portion 21 is required to have a hollow structure, and thus the heat radiation property of the support member 20 is deteriorated. However, according to this embodiment, the storage body 30 is provided with the lead-in hole 54, and thus the heat radiation performance of the support member 20 can be enhanced without configuring the projecting portion 21 in a hollow structure.

The above-described embodiment is merely an example of the present invention, and any modification and any application can be made without departing from the subject matter of the present invention.

For example, in the above embodiment, the base type lamp having the base 40 is described. However, the present invention is not limited to this style, and the lamp may be configured to have a plug-in type connector in place of the base 40.

Furthermore, in the above embodiment, the column body 26 provided to the support member 20 is configured to be Y-shaped in cross-section by joining the end portions of the arm 21. However, the present invention is not limited to this style, but the column body 26 may be configured so that a rod-shaped column is disposed along the axial line K and arms 21 extend radially from the peripheral surface of the column. At this time, the arms 21 may be scattered along the axial line in contact with the back surface of the light source unit 10.

DESCRIPTION OF REFERENCE NUMERALS

1, 100, 101, 102 LED lamp (lamp)
10, 110 light source unit
11 LED (light emitting element)
12 mount board
13, 63 base member
13A, 63A surface
13B, 63B back surface
14, 64 waterproof cover
15, 115 heat radiation fin
17 lead-out hole
20 support member
21 projecting portion (arm)
30, 130 storage body
40 base
52 one end portion (one end)
53 other end portion (other end)
54 lead-in hole
55 center portion
62 joint member
62A opening
G gap
K axial line
R, R1 space

The invention claimed is:

1. A lamp including:

a plurality of flat plate type light source units arranged around an axial line while back surfaces thereof face inwards, each of the light source units having a mount board having a light emitting element mounted on the surface of a base member; and a support member provided on the axial line, wherein the plurality of light source units are supported on the support member while a gap is provided between the adjacent light source units, a space through which air flows is provided at a back surface side of each base member, and the support member has a storage body in which respective lead wires from the plurality of light source units are accommodated without being exposed to the space through which air flows, and the plurality of light source units are supported on the storage body.

2. The lamp according to claim 1, wherein one ends of the plurality of light source units are cantilevered to the periphery of the storage body.

3. The lamp according to claim 2, wherein the other ends of the plurality of light source units are joined to one another by a joint member, and the joint member is provided with an opening through which the space intercommunicates with the outside in the direction of the axial line.

4. The lamp according to claim 1, wherein the storage body is provided with a base.

5. The lamp according to claim 1, wherein connectors are secured to the wires from the plurality of light source units, and a board in which the connectors are inserted is provided in the storage body.

6. The lamp according to claim 1, wherein the surface of the base member has a waterproof structure for waterproofing the mount board, a lead-out hole for leading out the lead wires is provided to the back surface of the base member, the support member has a lead-in hole for leading the lead wires from the lead-out hole into the support member, the light source unit and the support member are brought into close contact with each other to waterproof the lead-out hole and the lead-in hole, and the respective lead wires accommodated in the storage body are waterproofed by blocking the storage body.

7. The lamp according to claim 1, wherein the storage body is provided with a base, and the storage body is blocked by the base.

8. The lamp according to claim 6, wherein the storage body is provided with the lead-in hole.

9. The lamp according to claim 1, wherein the light source unit has a waterproof cover which covers the mount board.

10. The lamp according to claim 1, wherein the back surface of the base member is provided with a plurality of heat radiation fins.

11. The lamp according to claim 1, wherein the support member has a column extending from the storage body, one ends of the plurality of light source units are supported on the storage body, and the other ends thereof are supported on the tip of the column.

12. The lamp according to claim 11, wherein the support member is provided with a plurality of heat radiation fins.

13. The lamp according to claim 11, wherein the support member is provided with projecting portions, and the light source units are supported on the projecting portions.

14. The lamp according to claim 13, wherein the projecting portions extend in a longitudinal direction of the support member, and the back surfaces of the base members are in contact with the projecting portions.

15. The lamp according to claim 13, wherein each of the projecting portions is configured so that a center portion thereof is higher than both the end portions thereof in the longitudinal direction of the support member.

16. The lamp according to claim 13, wherein the projecting portions are radially provided to the support member, a plurality of support members which are different in number of the projecting portions are prepared, the plurality of light source units have the same shape, and the output power of the lamp is changeable by changing the number of light source units to be secured to the support member.

17. The lamp according to claim 7, wherein the storage body is provided with the lead-in hole.

* * * * *